US008807651B2

(12) United States Patent
LaPointe et al.

(10) Patent No.: US 8,807,651 B2
(45) Date of Patent: Aug. 19, 2014

(54) POWER LIFT LUMBAR SUPPORT SYSTEM

(71) Applicant: La-Z-Boy Incorporated, Monroe, MI (US)

(72) Inventors: Larry P. LaPointe, Temperance, MI (US); Chad E. Adams, Perrysburg, OH (US); Eric B. Harwood, Toledo, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 13/930,285

(22) Filed: Jun. 28, 2013

(65) Prior Publication Data

US 2013/0334854 A1 Dec. 19, 2013

Related U.S. Application Data

(62) Division of application No. 12/886,782, filed on Sep. 21, 2010, now Pat. No. 8,474,909.

(51) Int. Cl.

| | |
|---|---|
| ***A47C 3/00*** | (2006.01) |
| ***A47C 7/50*** | (2006.01) |
| ***A47C 7/46*** | (2006.01) |

(52) U.S. Cl.

CPC .. *A47C 7/462* (2013.01); *A47C 7/50* (2013.01)
USPC ..... 297/284.8; 297/284.4

(58) Field of Classification Search

USPC ..... 297/284.1, 284.4, 284.8
See application file for complete search history.

(56) References Cited

U.S. PATENT DOCUMENTS

| | | | |
|---|---|---|---|
| 3,890,000 | A | 6/1975 | Easley |
| 4,148,522 | A | 4/1979 | Sakurada et al. |
| 4,182,533 | A | 1/1980 | Arndt et al. |
| 4,295,681 | A | 10/1981 | Gregory |
| 4,296,965 | A | 10/1981 | Sakurada et al. |
| 4,678,230 | A | 7/1987 | Winkle |

(Continued)

FOREIGN PATENT DOCUMENTS

| | | |
|---|---|---|
| DE | 36 00 790 | 7/1987 |
| EP | 0 458 440 | 11/1991 |
| JP | 05-207920 | 8/1933 |
| WO | WO 2008/006200 | 1/2008 |

OTHER PUBLICATIONS

International Search Report for PCT/US2011/047371 mailed Apr. 9, 2012.

(Continued)

*Primary Examiner* — Milton Nelson, Jr.
(74) *Attorney, Agent, or Firm* — Harness, Dickey & Pierce, P.L.C.

(57) ABSTRACT

A power lift lumbar support system for a furniture member includes a lumbar pad. A scissoring portion is rotatably connected to the lumbar pad and moves the lumbar pad between a fully retracted and a fully extended position. A lumbar actuation portion is connected to the scissoring portion and drives the scissoring portion using a powered actuator to displace the lumbar pad. A carrier support rod has first and second carriers slidably disposed on the carrier support rod. The scissoring portion is connected to each of the first and second carriers. Displacement of the first and second carriers toward each other operates through the scissoring portion to displace the lumbar pad away from the carrier support rod and toward the fully extended position.

30 Claims, 25 Drawing Sheets

(56) References Cited

U.S. PATENT DOCUMENTS

| | | | | |
|---|---|---|---|---|
| 4,725,095 | A | | 2/1988 | Benson et al. |
| 4,968,093 | A | | 11/1990 | Dal Monte |
| 4,981,325 | A | | 1/1991 | Zacharkow |
| 5,007,677 | A | | 4/1991 | Ozawa et al. |
| 5,087,098 | A | | 2/1992 | Ishizuka |
| 5,088,790 | A | | 2/1992 | Wainwright et al. |
| 5,217,278 | A | | 6/1993 | Harrison et al. |
| 5,240,308 | A | | 8/1993 | Goldstein et al. |
| 5,462,335 | A | * | 10/1995 | Seyler ..... 297/284.4 |
| 5,474,358 | A | | 12/1995 | Maeyaert |
| 5,553,919 | A | | 9/1996 | Dennis |
| 5,871,258 | A | | 2/1999 | Battey et al. |
| 5,979,984 | A | | 11/1999 | DeKraker et al. |
| 6,086,153 | A | | 7/2000 | Heidmann et al. |
| 6,116,695 | A | | 9/2000 | Heidmann et al. |
| 6,179,384 | B1 | | 1/2001 | DeKraker et al. |
| 6,367,877 | B1 | | 4/2002 | Knoblock et al. |
| 6,394,545 | B2 | | 5/2002 | Knoblock et al. |
| 6,394,548 | B1 | | 5/2002 | Battey et al. |
| 6,394,549 | B1 | | 5/2002 | DeKraker et al. |
| 6,402,246 | B1 | | 6/2002 | Mundell |
| 6,572,190 | B2 | | 6/2003 | Koepke et al. |
| 6,575,530 | B1 | | 6/2003 | Fischer et al. |
| 6,609,755 | B2 | | 8/2003 | Koepke et al. |
| 6,616,228 | B2 | | 9/2003 | Heidmann |
| 6,695,402 | B2 | | 2/2004 | Sloan, Jr. |
| 6,729,691 | B2 | | 5/2004 | Koepke et al. |
| 6,880,886 | B2 | | 4/2005 | Bodnar et al. |
| 6,908,153 | B2 | | 6/2005 | Blendea |
| 6,932,430 | B2 | | 8/2005 | Bedford et al. |
| 7,014,269 | B2 | | 3/2006 | Coffield et al. |
| 7,044,551 | B2 | | 5/2006 | Fujita et al. |
| 7,066,537 | B2 | | 6/2006 | Coffield et al. |
| 7,131,694 | B1 | | 11/2006 | Buffa |
| 7,165,811 | B2 | | 1/2007 | Bodnar et al. |
| 7,204,556 | B2 | | 4/2007 | Schwerdtner et al. |
| 7,226,130 | B2 | | 6/2007 | Tubergen et al. |
| 7,264,311 | B2 | | 9/2007 | Heidmann |
| 7,448,684 | B2 | | 11/2008 | Hsiao |
| 2005/0046251 | A1 | | 3/2005 | Foelster et al. |
| 2009/0079245 | A1 | | 3/2009 | Marcantoni |

OTHER PUBLICATIONS

Written Opinion of the International Searching Authority for PCT/US2011/047371 mailed Apr. 9, 2012.

Supplementary European Search Report for International Application No. EP 11 82 7153, mailed Jan. 13, 2014 (5 pages).

* cited by examiner

POWER LIFT LUMBAR SUPPORT SYSTEM

CROSS-REFERENCE TO RELATED APPLICATIONS

This application is a divisional of U.S. patent application Ser. No. 12/886,782 filed on Sep. 21, 2010. The entire disclosure of the above application is incorporated herein by reference.

FIELD

The present disclosure relates to lumbar support systems for furniture including occupant support members.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly between retracted and extended positions and separate components to allow a back seat member to recline with respect to a seat base. Known furniture members can also include mechanism designs that also permit the reclining chair to rock in a front-to-back motion with respect to an occupant. Occupant lumbar support is commonly provided by one or more cushion members that abut with or are connected to a horizontally configured member such as a strap, spring, or similar flexible member. This member is commonly joined at its ends to vertically oriented backrest side support arms which are in turn rotatably connected to a furniture member chair frame.

Most reclining chairs upholster the chair frame and support the chair frame from a stationary base. Because lumbar support is substantially fixed to the back seat member, as the back seat member rotates, the lumbar cushion(s) provide the "feeling" to the occupant that they are extending forwardly and upwardly. This creates different lumbar support for the different rotated positions of the seatback. Many lumbar support systems are either not adjustable by the occupant, or adjustable using a manual system that would require continuous repositioning of the lumbar supports as the seatback rotates, and therefore can result in discomfort in either the fully reclined or upright positions, or in the leg rest extended position for different occupants.

SUMMARY

This section provides a general summary of the disclosure, and is not a comprehensive disclosure of its full scope or all of its features.

According to several embodiments, a power lift lumbar support system for a furniture member includes a lumbar pad. A scissoring portion is rotatably connected to the lumbar pad to move the lumbar pad between a fully retracted and a fully extended position. A lumbar actuation portion is connected to the scissoring portion and drives the scissoring portion using a powered actuator to displace the lumbar pad when the powered actuator is actuated.

According to further embodiments, a power lift lumbar support system for a furniture member includes a lumbar pad. A scissoring portion is rotatably connected to the lumbar pad and moves the lumbar pad between a fully retracted and a fully extended position. A lumbar actuation portion is connected to the scissoring portion and drives the scissoring portion using a powered actuator to displace the lumbar pad. A carrier support rod has first and second carriers slidably disposed on the carrier support rod. The scissoring portion is connected to each of the first and second carriers. Displacement of the first and second carriers toward each other operates through the scissoring portion to displace the lumbar pad away from the carrier support rod and toward the fully extended position.

According to other embodiments, a power lift lumbar support system for a furniture member includes a lumbar pad. A scissoring portion rotatably connected to the lumbar pad operates in a scissoring action to move the lumbar pad between a fully retracted and a fully extended position. A lumbar actuation portion is connected to the scissoring portion and operates to displace the scissoring portion using a powered actuator to displace the lumbar pad. The lumbar actuation portion includes a displaceable shaft. Movement of the displaceable shaft in a first displacement direction displaces the lumbar pad toward the fully extended position, and movement of the displaceable shaft in an opposite second displacement direction returns the lumbar pad toward the fully retracted position.

According to further embodiments, a power lift lumbar support system for a furniture member includes a lumbar pad. A scissoring portion rotatably connected to the lumbar pad operates to move the lumbar pad between a fully retracted and a fully extended position. A carrier support rod has first and second carriers slidably disposed on the carrier support rod. The scissoring portion is connected to each of the first and second carriers. A linkage set is connected to the first and second carriers. A lumbar actuation portion having a powered actuator connected to the linkage set operates to drive the first and second carriers to displace the scissoring portion and thereby the lumbar pad.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
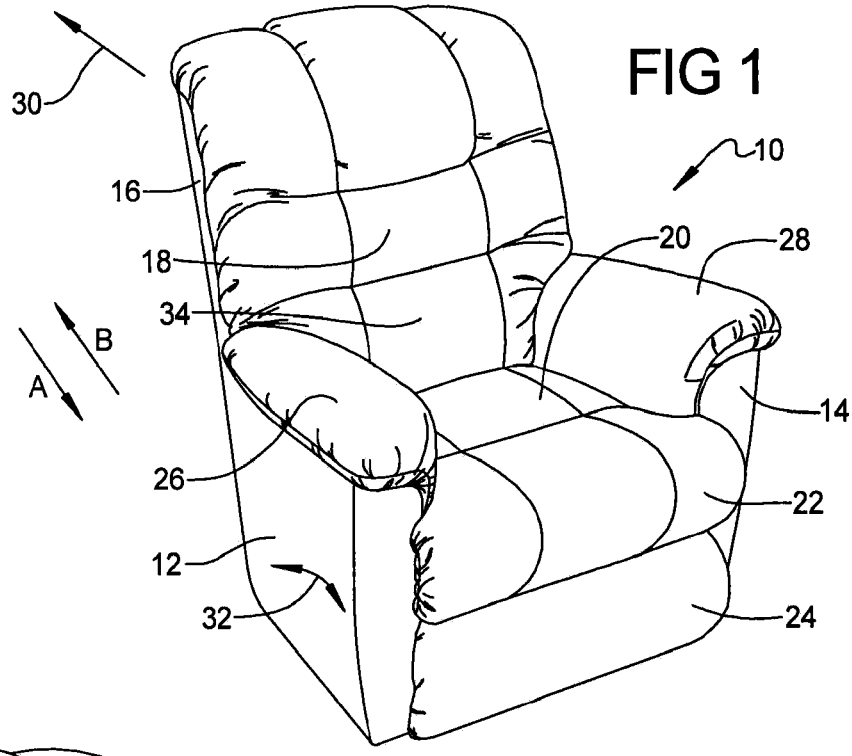
FIG. 1 is a front perspective view of a furniture member having an in-line linkage mechanism of the present disclosure.

Example embodiments will now be described more fully with reference to the accompanying drawings.

Example embodiments are provided so that this disclosure will be thorough, and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers, and/or sections, these elements, components, regions, layers, and/or sections should not be limited by these terms. These terms may be only used to distinguish one element, component, region, layer, or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
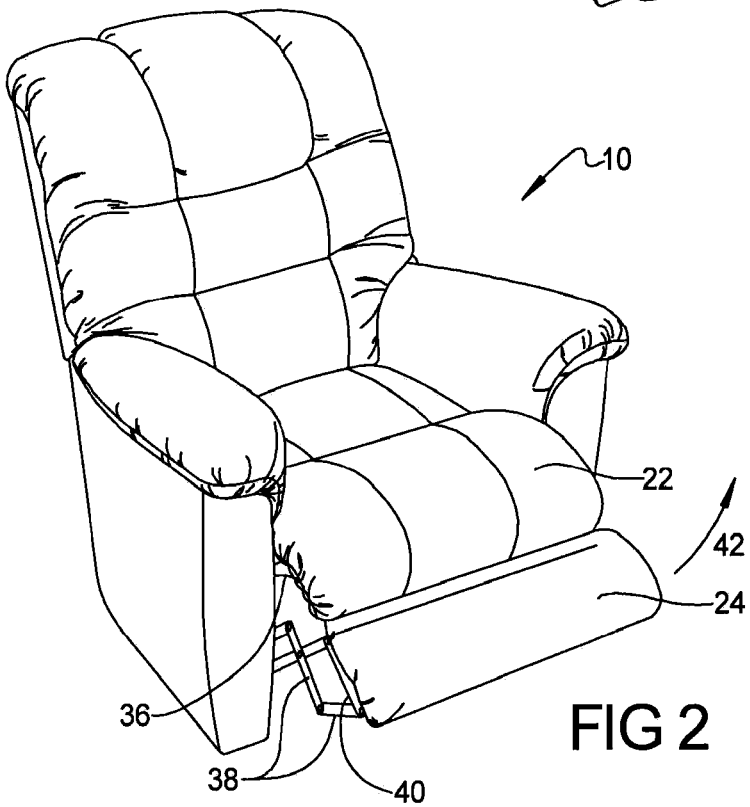
FIG. 2 is a front perspective view of the furniture member of FIG. 1 having a leg rest assembly shown in an extended position.

Referring generally to FIG. 1, a furniture member 10 depicted as a reclining chair includes first and second sides 12, 14 and an occupant seatback 16 covered with a seatback cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14, respectively. An occupant's weight generally centered on support member 20 is normally operable to maintain seatback 16 in an upright position. When the leg rest assembly 24 is positioned in a stowed or fully retracted position shown, seatback 16 cannot be manually reclined or rotated with respect to a seatback arc of rotation 30. Seatback 16 can rotate about arc of rotation 30 from the upright position shown to a fully reclined position (not shown). Seatback 16 returns to the upright position shown and opposite to seatback arc of rotation 30 when desired by the occupant, and leg rest assembly 24 can similarly be returned from a fully extended position (shown in reference to FIG. 2) to the fully retracted position shown.

According to several embodiments, furniture member 10 can independently rotate or rock forwardly and rearwardly about a furniture member arc of rotation 32 by motion of the occupant and without requiring powered operation. A lumbar support section 34 can be moved either in a lumbar extension direction "A" to increase occupant lumbar support or in a lumbar retraction direction "B" to decrease occupant lumbar support. In the embodiment shown, furniture member 10 is depicted as a chair; however, the present teachings are not limited to chairs. Furniture member 10 can be any of a plurality of furniture members including, but not limited to, single or multiple person furniture members, sofas, sectional members, and/or loveseats.

Referring to FIG. 2 and again to FIG. 1, an actuation mechanism 36 can be either a manual or an automatic actuated device controlled by the occupant to direct the repositioning of leg rest assembly 24 from the stowed position (shown in FIG. 1) to an extended position. Actuation mechanism 36 supports and permits both extension and retraction of leg rest assembly 24, as well as rotation of seatback 16. More specifically, actuation mechanism 36 includes first and second pantograph linkage sets 38, 38' (second pantograph linkage set 38' is not visible in this view) which are linked to leg rest assembly 24 using first and second leg rest support arms 40, 40' (only first leg rest support arm 40' is visible in this view). Leg rest assembly 24 can be moved from the fully retracted position (shown in FIG. 1) to an extended position by motion of the leg rest assembly 24 about a leg rest extension arc 42. It will be apparent that rotation of leg rest assembly 24 in an opposite direction from extension arc 42 will return leg rest assembly 24 to the retracted position.

Figure 3:
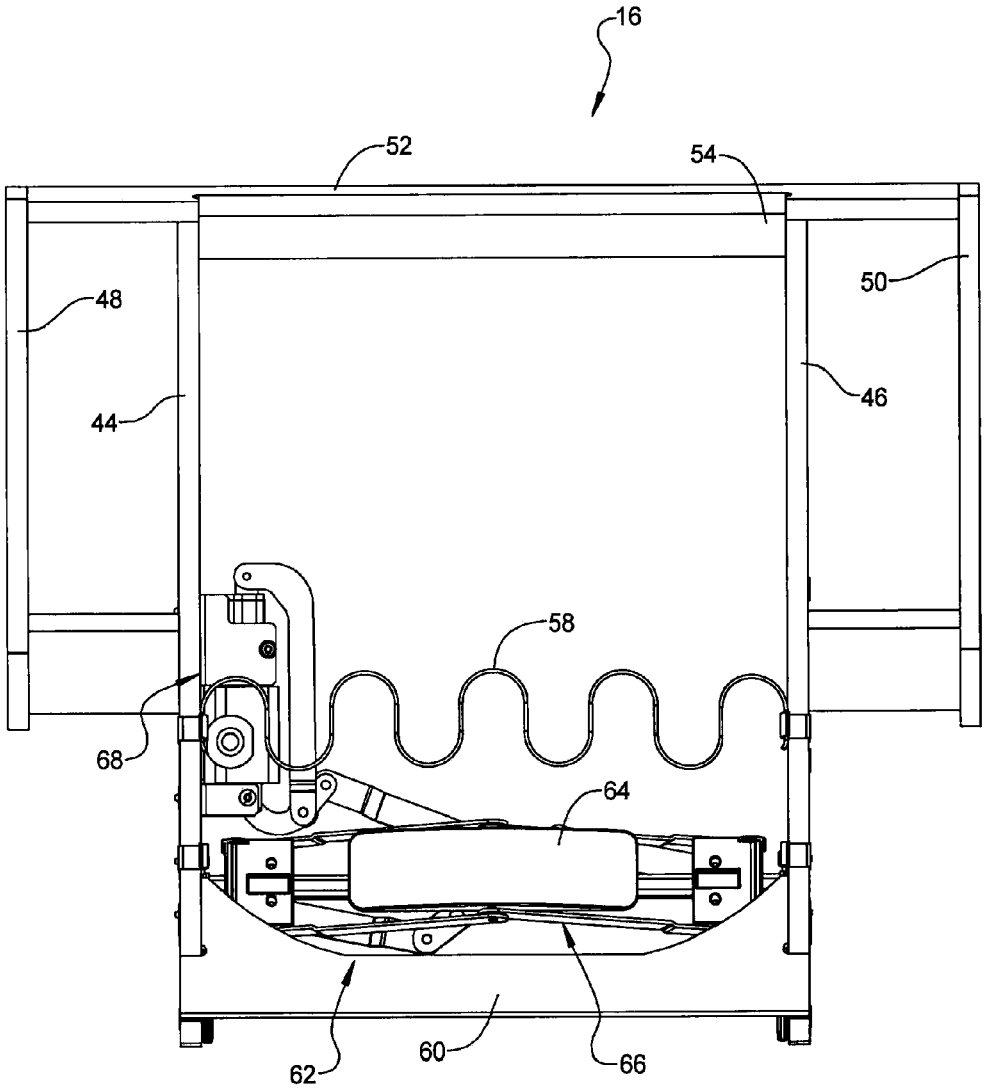
FIG. 3 is a front elevational view of the seatback assembly of the furniture member of FIG. 1 having the upholstery removed for clarity.

Referring to FIG. 3, seatback 16 is shown having upholstery and any padding removed such that only the frame and supported elements are visible for clarity. Seatback 16 includes each of a first and a second seatback side member 44, 46 which according to several embodiments are constructed of a wood material, and first and second extension wings 48, 50 connected to and extending outwardly with respect to the first and second seatback side members 44, 46, also constructed of wood. A seatback upper frame member 52 connects to and braces each of the first and second seatback side members 44, 46 and first and second extension wings 48, 50. An upper brace member 54 can also be included which connects at opposite ends 56, 56' to the first and second seatback side members 44, 46 to additionally structurally support these members.

Occupant support provided by seatback 16 can include one or a plurality of biasing members 58 connected to first and second seatback side members 44, 46. According to several embodiments, biasing member 58 is a sinuous wire spring; however, biasing member 58 can also take the form of multiple different types of biasing members including single wire elements, flexible slats, elastic straps, and the like. A lower brace member 60 provides a similar stiffening effect between first and second seatback side members 44, 46 as provided by upper brace member 54.

A lumbar mechanism 62 is positioned in a space between first and second seatback side members 44, 46. Lumbar mechanism 62 includes a lumbar pad 64 which is movable toward and away from the viewer (as shown in FIG. 3) at the discretion of the occupant. Lumbar pad 64 is connected to and displaceable using a scissoring portion 66 of lumbar mechanism 62. Lumbar mechanism 62 further includes a lumbar actuation portion 68 which according to several embodiments is electrically powered to displace scissoring portion 66 and thereby to displace lumbar pad 64.

Figure 4:
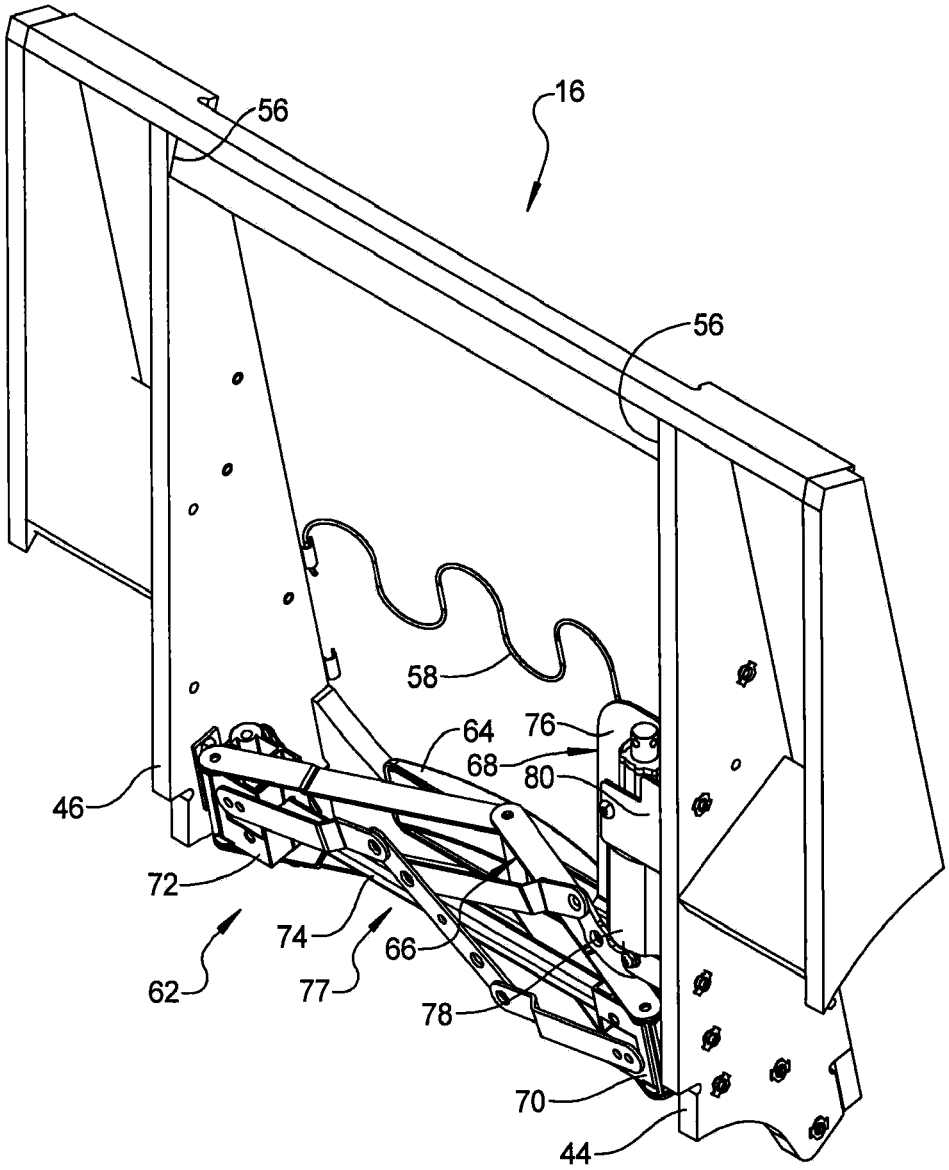
FIG. 4 is a right rear perspective view of the seatback assembly of FIG. 3.

Referring to FIG. 4, lumbar mechanism 62 further includes first and second carriers 70, 72 which are each slidably disposed with respect to a carrier support rod 74. Carrier support rod 74 is, in turn, connected to each of first and second seatback side members 44, 46. Movement of first and second carriers 70, 72 is caused by operation of lumbar actuation portion 68 and, in particular, by displacement of an actuation link 76 connected to a linkage set 77. Actuation link 76 is connected to an actuator 78. Operation of actuator 78 displaces actuation link 76 and linkage set 77 which slidably displaces first and second carriers 70, 72. Actuator 78 can be an electrical device, such as an electrical motor or an electrically operated air pump. Actuator 78 is connected to a bracket 80 which is fastenably connected to first seatback side member 44.

Figure 5:
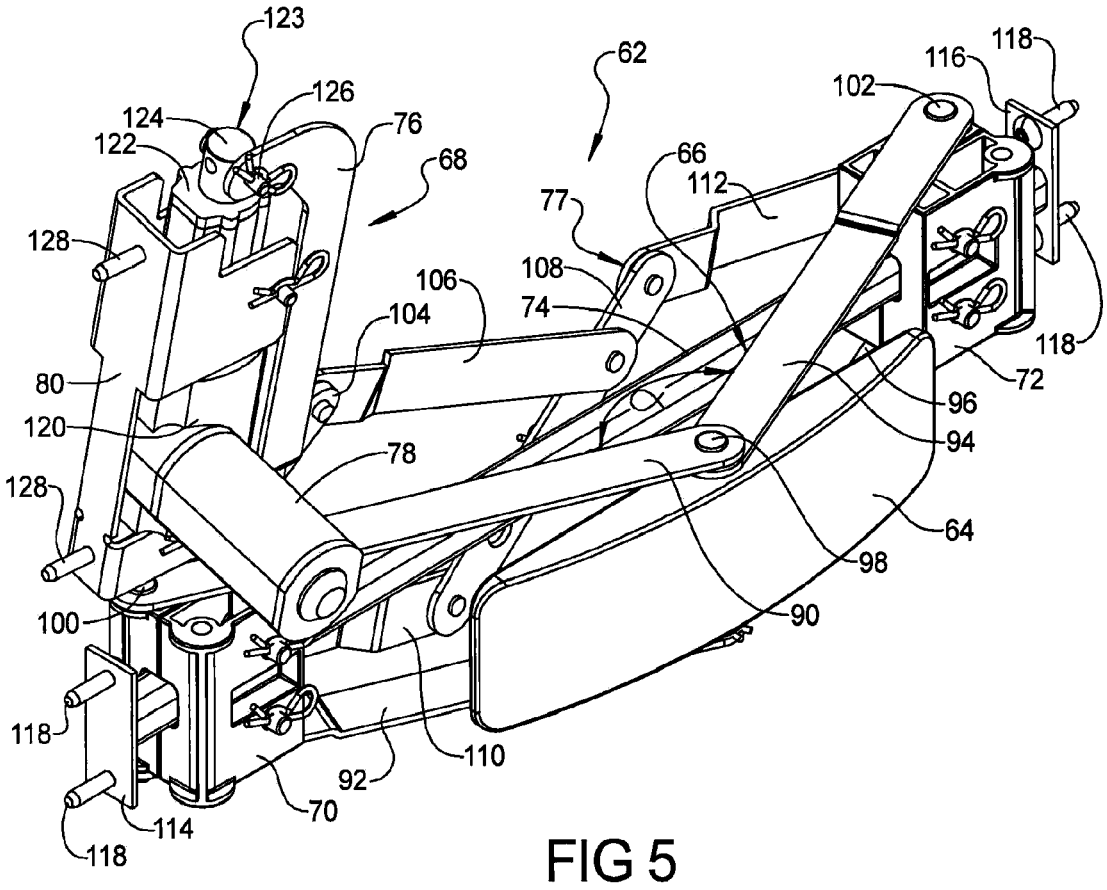
FIG. 5 is a front right perspective view of a lumbar mechanism of the present disclosure.

Referring to FIG. 5, scissoring portion 66 includes a first upper pad link 90 and a first lower pad link 92, each rotatably connected to first carrier 70. Similarly, a second upper pad link 94 and a second lower pad link 96 are both rotatably connected to second carrier 72. Each of the first upper pad link 90, first lower pad link 92, second upper pad link 94, and second lower pad link 96 are commonly rotatably connected using a pad connecting pin 98 to lumbar pad 64. First upper pad link 90 and first lower pad link 92 are both rotatably connected to first carrier 70 using a first carrier connecting pin 100. Similarly, second upper pad link 94 and second lower pad link 96 are both rotatably connected to second carrier 72 using a second carrier connecting pin 102. Sliding motion of the first and second carriers 70, 72 on carrier support rod 74 displaces lumbar pad 64 either away from or towards carrier support rod 74 via angular movement (with respect to each other) of the rigid upper and lower pad links 90, 92, 94, 96. In a fully retracted position of lumbar pad 64 (shown in FIG. 5), first upper pad link 90 and second upper pad link 94 are oriented at an angle $\alpha$ with respect to a longitudinal axis of pad connecting pin 98. According to several embodiments, angle $\alpha$ is greater than 90 degrees in the fully retracted position. First and second lower pad links 92, 96 mimic the orientation of first and second upper pad links 90, 94 and are therefore also oriented at angle $\alpha$ in the fully retracted position of lumbar pad 64.

As previously noted, actuation link 76 is connected to the first and second carriers 70, 72 through linkage set 77. Linkage set 77 includes a force transfer link 104 rotatably connected at one end to actuation link 76, and rotatably connected at an opposite end to a drive link 106. Drive link 106 is, in turn, rotatably connected to a connecting link 108. Connecting link 108 is rotatably connected at opposed ends to each of a first carrier displacement link 110 and a second carrier displacement link 112. First carrier displacement link 110 is rotatably connected to first carrier 70, and second carrier displacement link 112 is rotatably connected to second carrier 72.

With further reference to both FIGS. 4 and 5, first and second mount plates 114, 116 are each fixedly connected to opposing ends of carrier support rod 74. A plurality of mounting fasteners 118 are connected to each of the first and second mount plates 114, 116 which are used to fastenably connect to the first and second seatback side members 44, 46. Lumbar actuation portion 68 can further include a power transfer device 120 connected to and driven by actuator 78. According to several embodiments, power transfer device 120 can include one or more gears or cams configured to change the rotational speed of actuator 78 and the direction of force of actuator 78 to a direction commensurate with the orientation of a lumbar actuation mechanism 122 having a free end 123 of a displaceable shaft 124 extendable and retractable with respect to lumbar actuation mechanism 122. Free end 123 of displaceable shaft 124 is rotatably connected to actuation link 76 using a fastener assembly 126. Bracket 80 can include one or a plurality of mounting fasteners 128 which are similar to mounting fasteners 118 and used to fastenably connect bracket 80.

Figure 6:
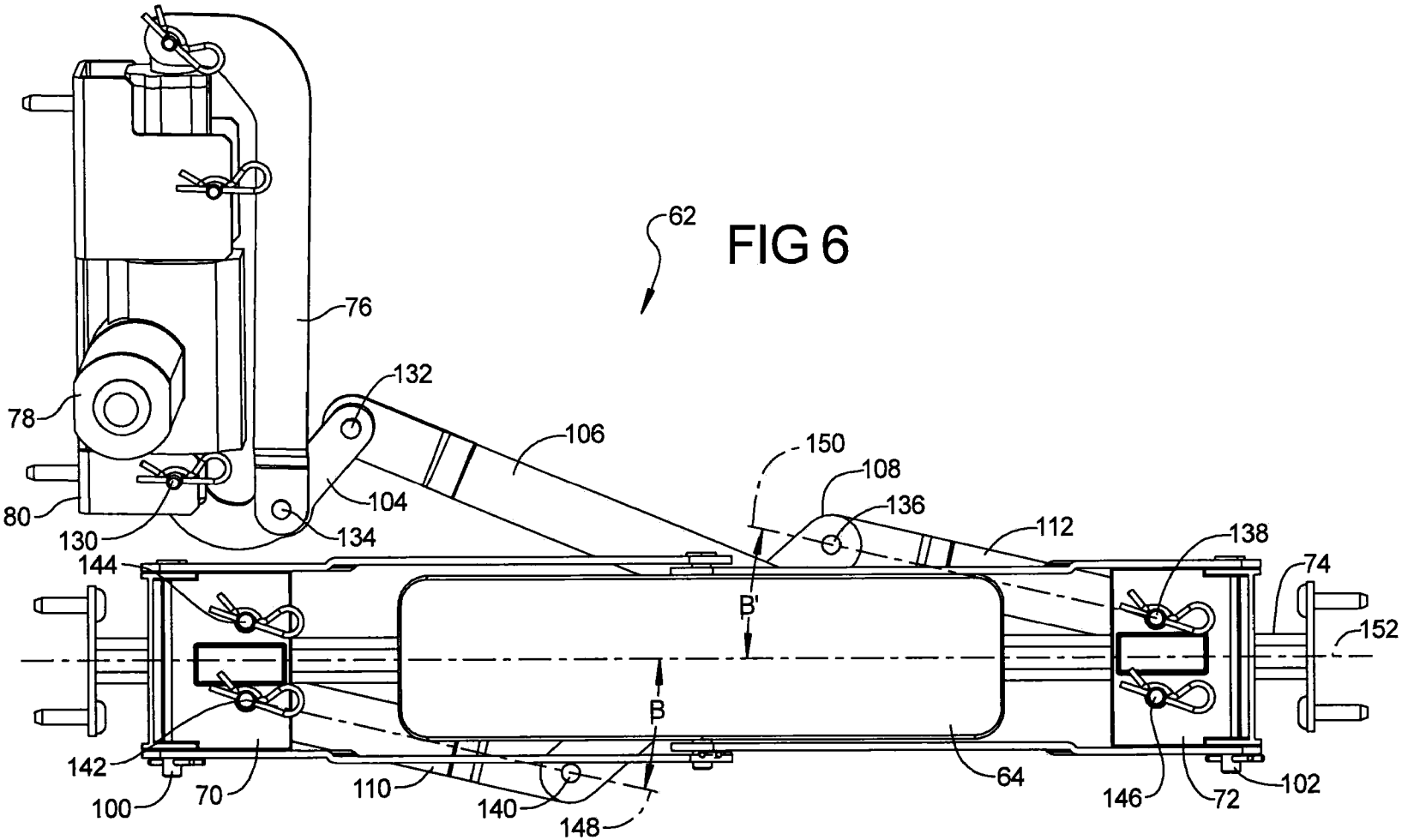
FIG. 6 is a front elevational view of the lumbar mechanism of FIG. 5.

Referring to FIG. 6, rotatable fasteners or pins can be used to connect the various link members of linkage set 77 and scissoring portion 66 of lumbar mechanism 62. These include a bracket connecting pin 130 which is inserted through bracket 80 and rotatably supports a first end of force transfer link 104. According to several embodiments, force transfer link 104 is generally U-shaped having bracket connecting pin 130 disposed at a first end and a rotational fastener 132 rotatably connected to drive link 106 at a second end. According to several embodiments, rotational fasteners used throughout this disclosure can be provided in multiple forms including rivets, such as spin rivets, and other fasteners known in the art used to provide rotational connections. A rotational fastener 134 is used to connect actuation link 76 to force transfer link 104 at a position between each of bracket connecting pin 130 and rotational fastener 132. A rotational fastener 136 is used to rotatably connect connecting link 108 to second carrier displacement link 112. A second carrier link connecting pin 138 is used to rotatably connect second carrier displacement link 112 to second carrier 72. Similarly, a rotational fastener 140 is used to rotatably connect connecting link 108 to first carrier displacement link 110. A first carrier link connecting pin 142 rotatably connects first carrier displacement link 110 to first carrier 70. Pin assemblies 144, 146 are also provided with each of first and second carriers 70, 72 to help support carrier support rod 74 in rod receiving cavities of each of first and second carriers 70, 72.

In the fully retracted position of lumbar pad 64 (as also shown in FIG. 6), a displacement link longitudinal axis 148, which extends through rotational fastener 140 and first carrier link connecting pin 142, is oriented at an angle β with respect to a rod longitudinal axis 152 of carrier support rod 74. Similarly, a displacement link longitudinal axis 150, extending through rotational fastener 136 and second carrier link connecting pin 138, is oriented at an angle β' with respect to rod longitudinal axis 152. According to several embodiments, angles β and β' are equal to each other when first and second carriers 70, 72 are at their greatest outward extension positions on carrier support rod 74 defining the fully retracted position of lumbar pad 64.

Figure 7:
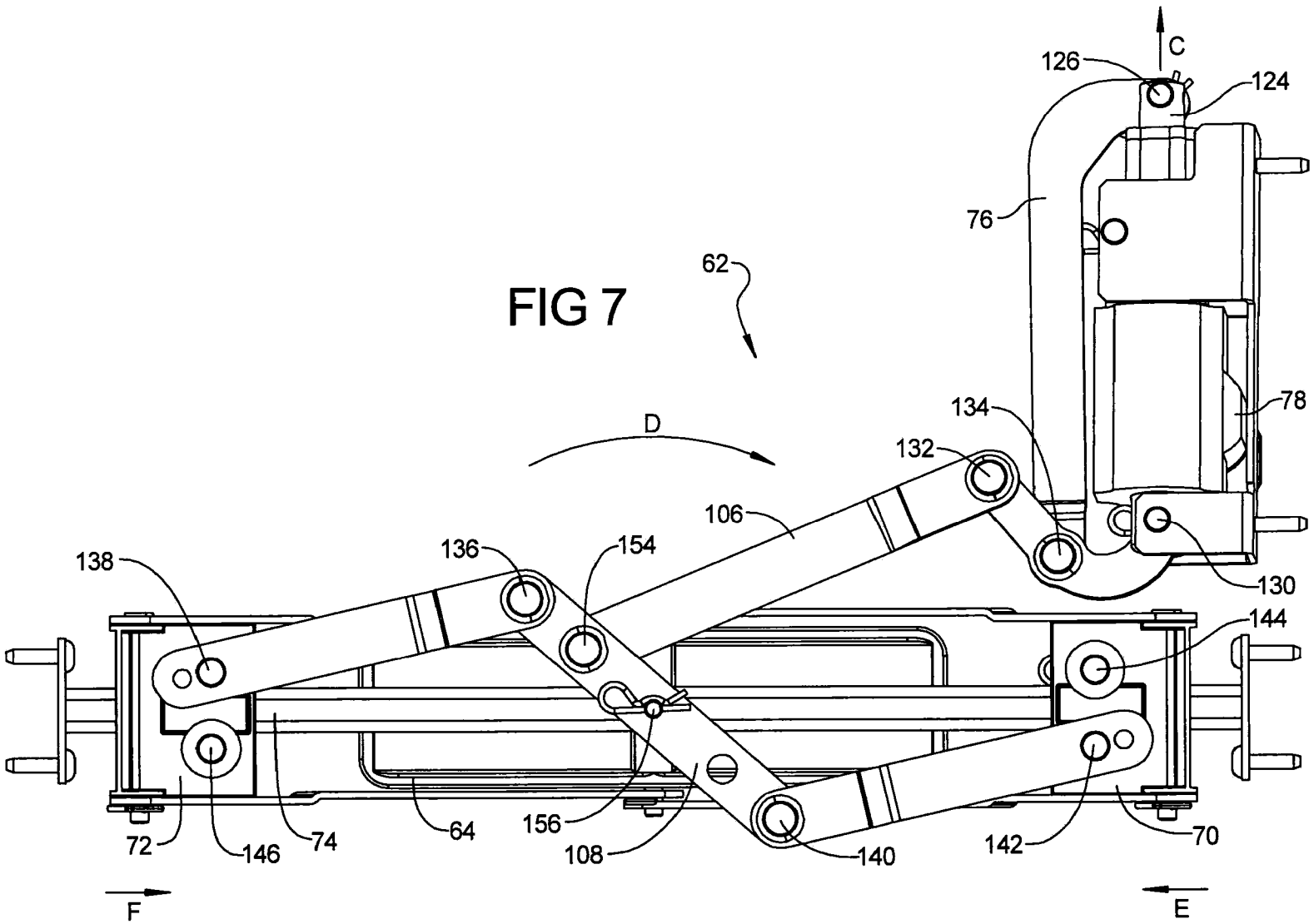
FIG. 7 is a rear elevational view of the lumbar mechanism of FIG. 5.

Referring to FIG. 7, to complete the rotational connection of the various links of linkage set 77, a rotational fastener 154 rotatably connects drive link 106 to connecting link 108 between the positions of rotational fasteners 136 and 140. A pin 156 rotatably connects connecting link 108 to a substantially central position of carrier support rod 74. Starting from the fully retracted position of lumbar pad 64 (as shown), operation of actuator 78 causes a longitudinal displacement of displaceable shaft 124 in an upward displacement direction "C". This displacement of displaceable shaft 124 causes rotation of connecting link 108 about an axial rotation arc "D" with respect to pin 156. Rotation of connecting link 108 in the axial rotation arc "D" causes displacement of first carrier 70 in a first carrier displacement direction "E" and displacement of second carrier 72 in a second carrier displacement direction "F" on carrier support rod 74. As previously noted, displacement of first and second carriers 70, 72 toward each other causes outward scissoring action of scissoring portion 66 and thereby extension of lumbar pad 64 away from carrier support rod 74.

Figure 8:
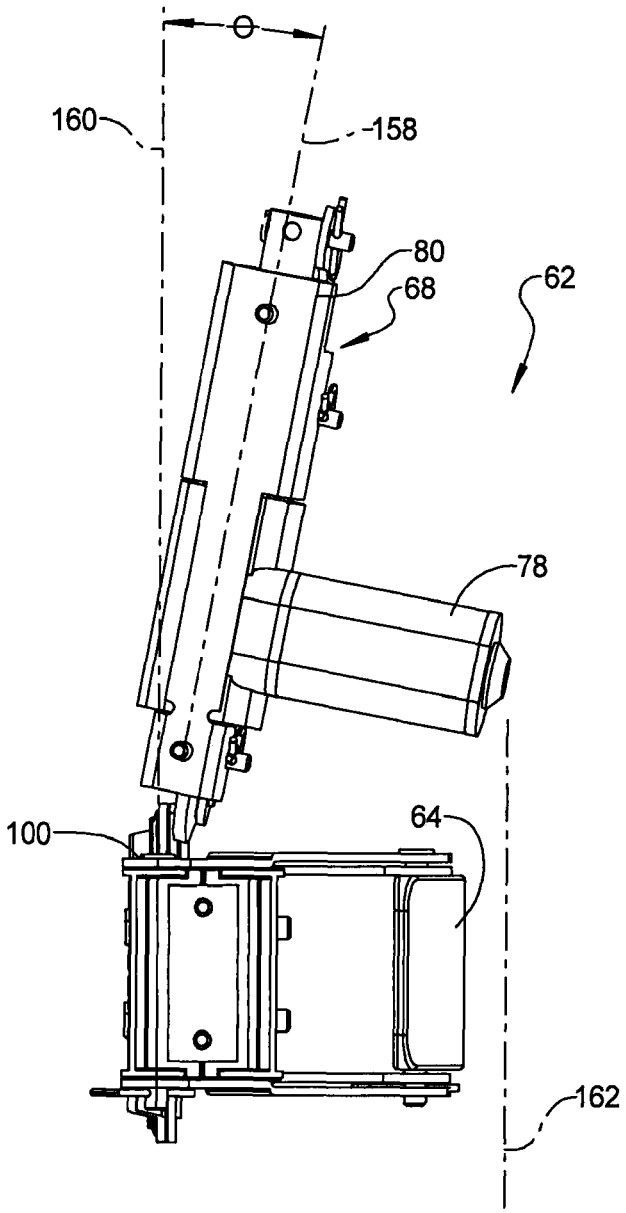
FIG. 8 is a right side elevational view of the lumbar mechanism of FIG. 5.

Referring to FIG. 8 and again to FIG. 4, with lumbar pad 64 in the fully retracted position, lumbar actuation portion 68 and bracket 80 are both oriented with respect to an actuation portion longitudinal axis 158 at an angle θ with respect to a pin longitudinal axis 160 defined through first carrier connecting pin 100. Angle θ is selected to retain lumbar actuation portion 68 and bracket 80 within the space envelope defined between first and second seatback side members 44, 46. In the fully retracted position of lumbar pad 64, lumbar pad 64 can be located rearward of a reference plane 162 defined at a forward facing end of actuator 78.

Figure 9:
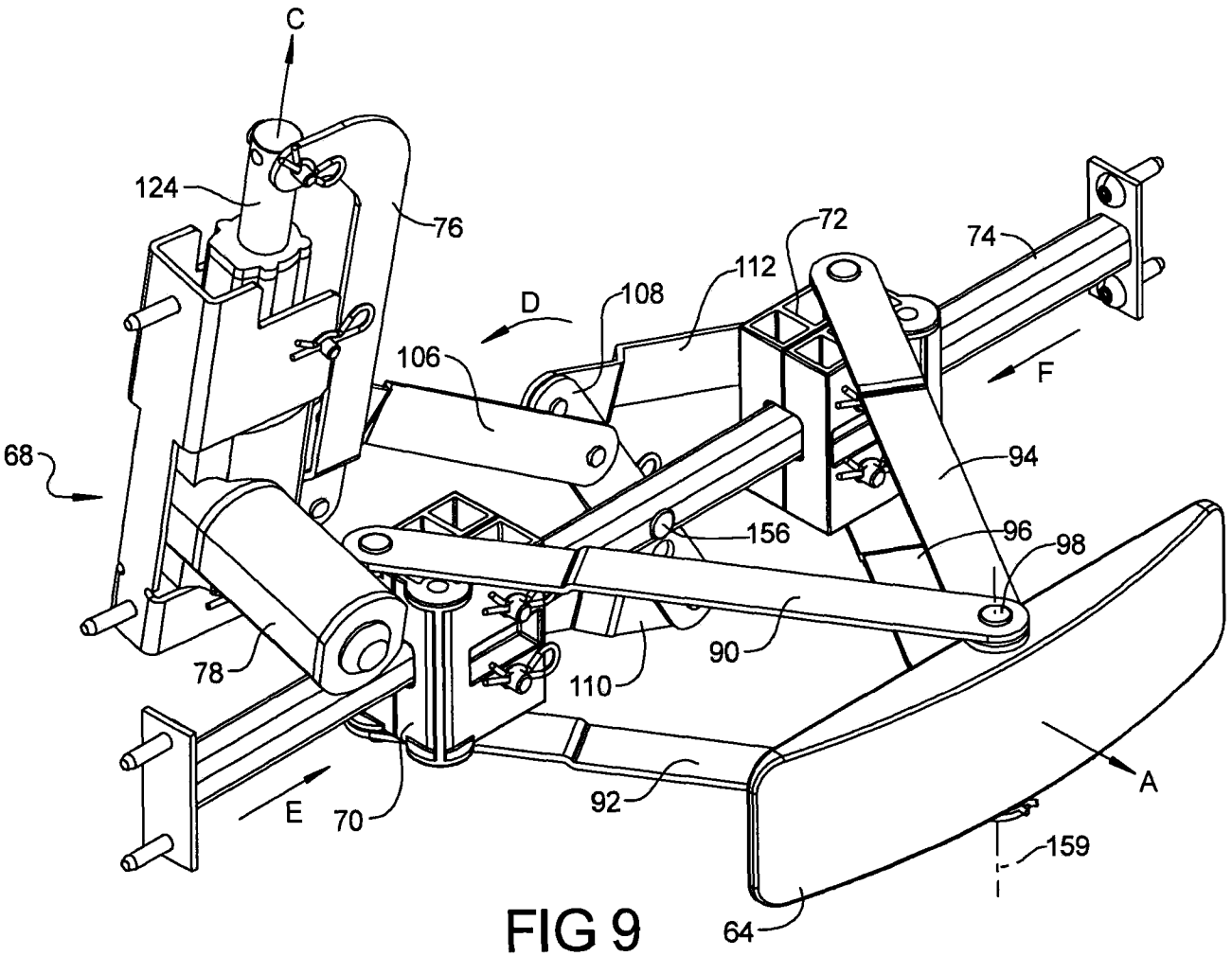
FIG. 9 is a front right perspective view of the lumbar mechanism of FIG. 5 further showing the lumbar pad in a fully forward extended position.

Referring to FIG. 9, a fully extended position of lumbar pad 64 is created by the following operations. Actuator 78 is operated to longitudinally displace displaceable shaft 124 in the upward displacement direction "C". This displacement of displaceable shaft 124 causes a similar displacement of actuation link 76 also in the upward displacement direction "C". As drive link 106 rotates due to the upward displacement of actuation link 76, connecting link 108 is caused to rotate in the axial rotation direction "D" with respect to a longitudinal axis of pin 156. This rotation of connecting link 108 generates a pulling force with respect to each of first and second carrier displacement links 110, 112, which subsequently displaces first carrier 70 in the first carrier displacement direction "E" and second carrier 72 in the second carrier displacement direction "F". As first and second carriers 70, 72 approach each other, first upper and lower pad links 90, 92 and second upper and lower pad links 94, 96 displace by scissoring action to move lumbar pad 64 in the lumbar extension direction "A".

Figure 10:
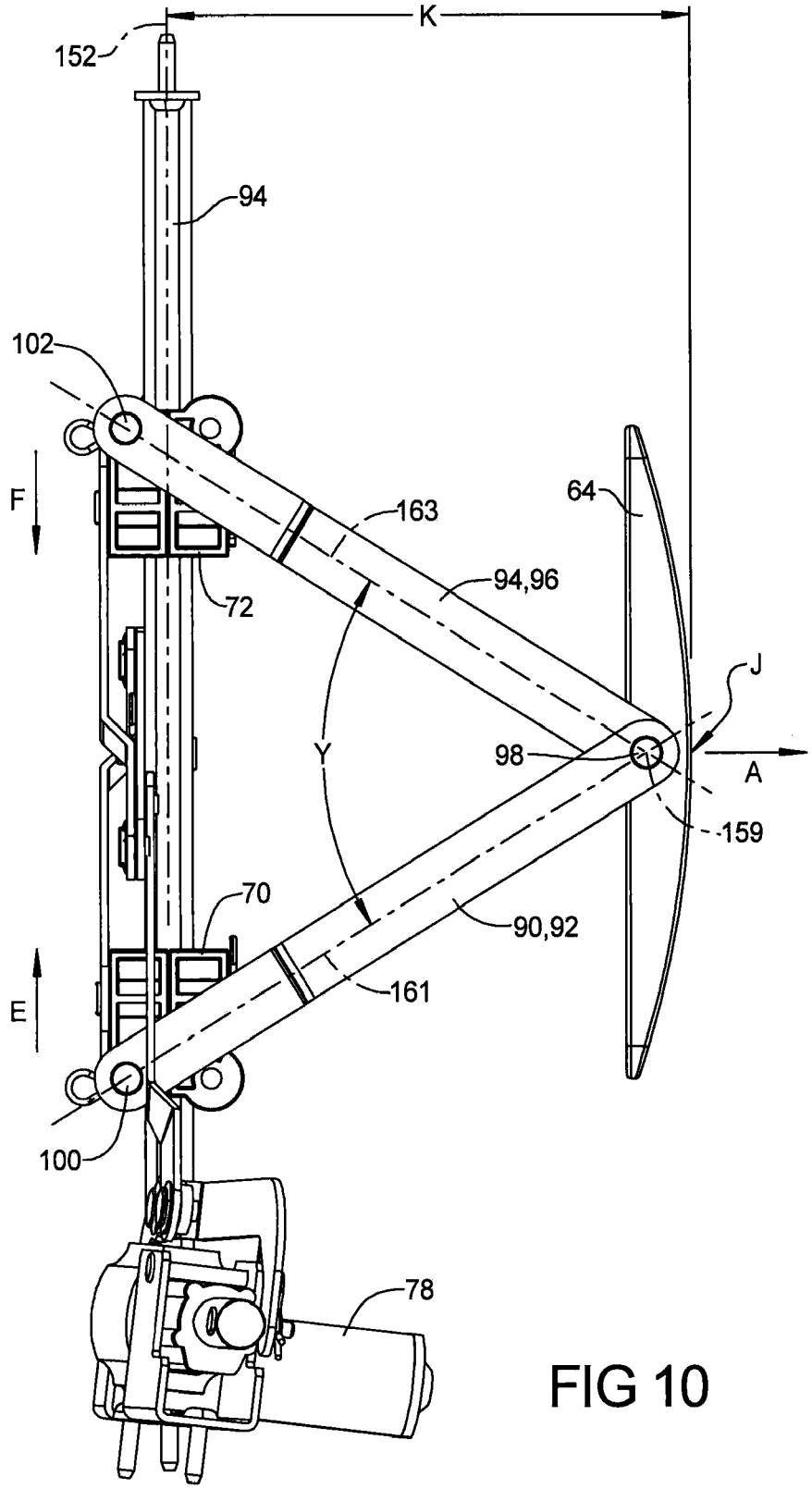
FIG. 10 is a top plan view of the lumbar mechanism of FIG. 9.

Referring to FIG. 10 and again to FIG. 9, when lumbar pad 64 reaches the fully extended position shown in the lumbar extension direction "A", an orientation angle γ is created between a first link longitudinal axis 161 and a second link longitudinal axis 163. First link longitudinal axis 161 is defined through first upper and lower pad links 90, 92 with respect to pad connecting pin 98 and first carrier connecting pin 100. Second link longitudinal axis 163 of second upper and lower pad links 94, 96 is defined through pad connecting pin 98 and second carrier connecting pin 102. According to several embodiments, angle γ is less than angle α and also less than 90° when lumbar pad 64 reaches the fully extended position.

It is also noted that lumbar pad 64 is rotatable with respect to a pin axis of rotation 159 defined by a longitudinal axis of pad connecting pin 98. This rotation of lumbar pad 64 accommodates limited side-to-side motion of the occupant of the furniture member while permitting continued contact by the occupant with lumbar pad 64. In the fully extended position of lumbar pad 64, a pad convex outer surface apex "J" extends away from rod longitudinal axis 152 of carrier support rod 74 by a total pad displacement "K". According to several embodiments, lumbar pad 64 can be positioned at any location between the fully retracted position and the fully extended position by selective operation of actuator 78.

Figure 11:
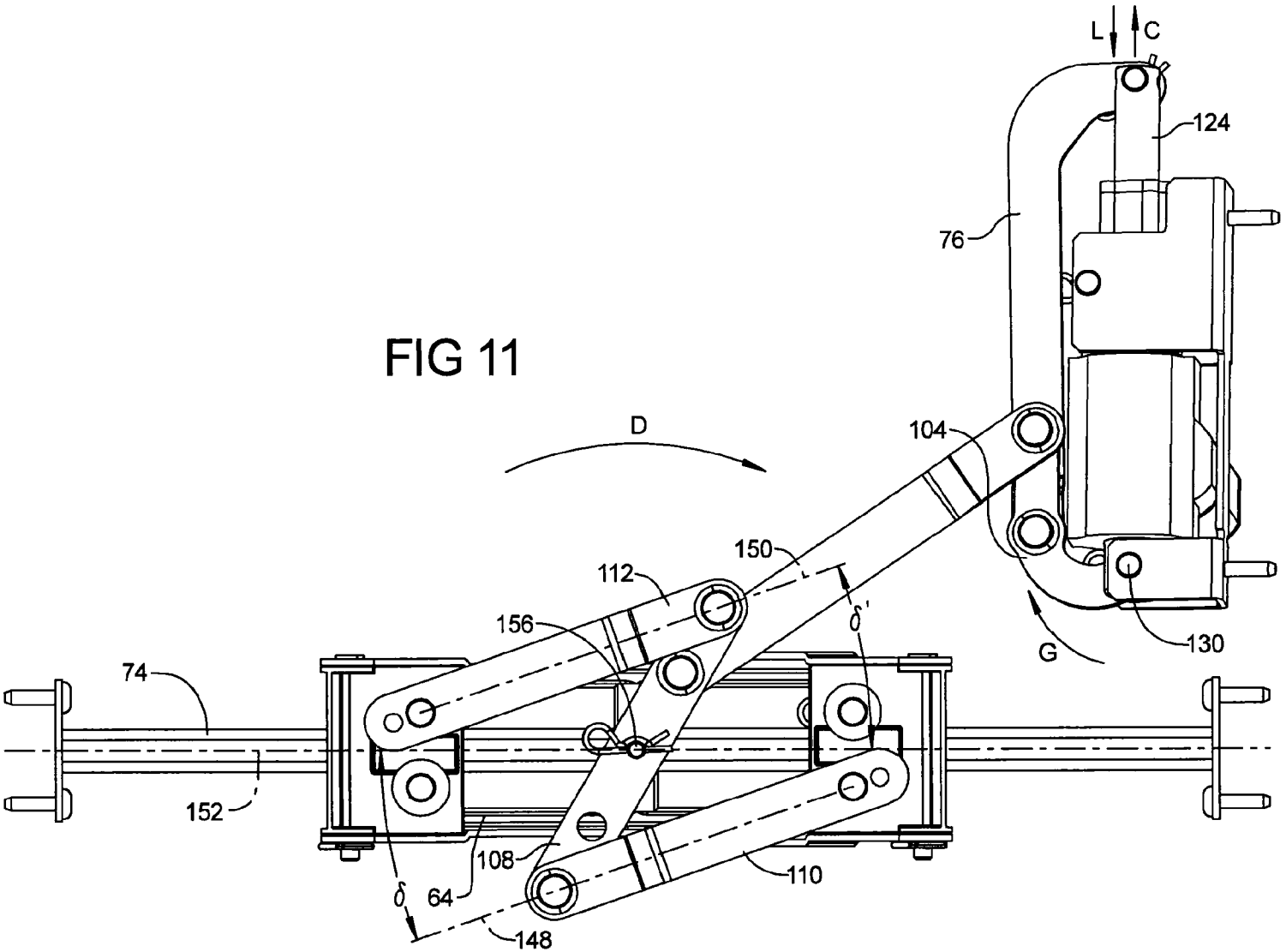
FIG. 11 is a rear elevational view of the lumbar mechanism of FIG. 9.

Referring to FIG. 11, as lumbar pad 64 is moved to the fully extended position by extension of displaceable shaft 124 in the upward displacement direction "C" and rotation of connecting link 108 in the axial rotation direction "D", force transfer link 104 rotates in a transfer link rotational arc "G" with respect to bracket connecting pin 130 to the position shown. With further reference to FIG. 6, the displacement link longitudinal axis 148 of first carrier displacement link 110 is reoriented to an angle δ with respect to rod longitudinal axis 152. Similarly, the displacement link longitudinal axis 150 of second carrier displacement link 112 is rotated to an angle δ' with respect to rod longitudinal axis 152. According to several embodiments, angle δ and angle δ' are equal angles at the fully extended position of lumbar pad 64. Retraction of displaceable shaft 124 in a retraction direction "L" will cause an opposite rotation of connecting link 108 (opposite to axial rotation arc "D") which will move first and second carriers 70, 72 away from each other and retract the lumbar pad toward the retracted position.

Figure 12:
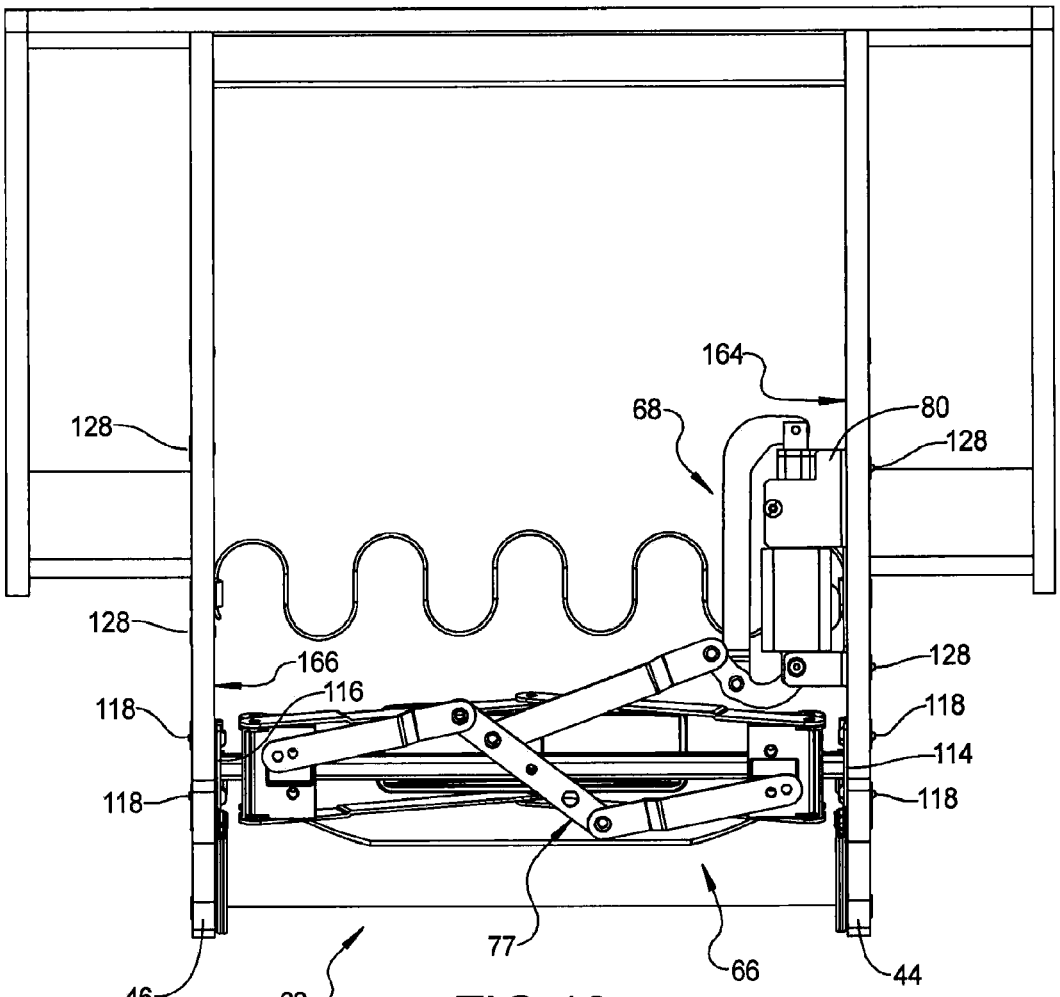
FIG. 12 is a rear elevational view of the seatback assembly of FIG. 4.

Referring to FIG. 12, first mount plate 114 is fastenably connected to a first interface wall 164 of first seatback side member 44 using mounting fasteners 118. Similarly, second mount plate 116 is fastenably connected to a second interface wall 166 of second seatback side member 46 also using mounting fasteners 118. Bracket 80 supporting lumbar actuation portion 68 is fastenably connected to first interface wall 164 using mounting fasteners 128. Lumbar mechanism 62, including scissoring portion 66, lumbar actuation portion 68, and linkage set 77, is retained within a space envelope defined by the first and second seatback side members 44, 46. Only lumbar pad 64 extends outside of the space envelope defined by first and second seatback side members 44, 46 when in the lumbar pad fully extended position.

Figure 13:
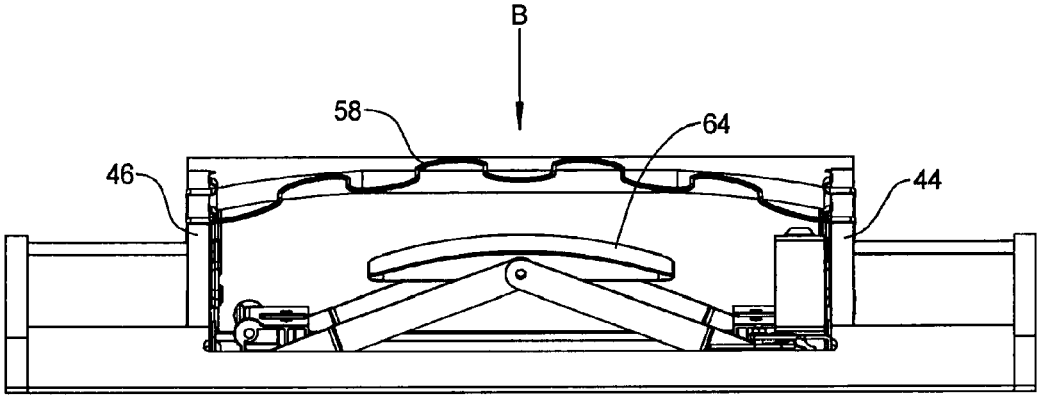
FIG. 13 is a top plan view of the seatback assembly of FIG. 4.

Referring to FIG. 13, lumbar pad 64 is shown in the fully retracted position having lumbar pad 64 displaced in the lumbar retraction direction "B" until lumbar pad 64 is positioned rearwardly of biasing member 58. In this position, lumbar pad 64 provides minimal lumbar support for the occupant of the furniture member. As previously noted, lumbar mechanism 62, including lumbar pad 64, is retained within the space envelope defined by the first and second seatback side members 44, 46 in the fully retracted position.

Figure 14:
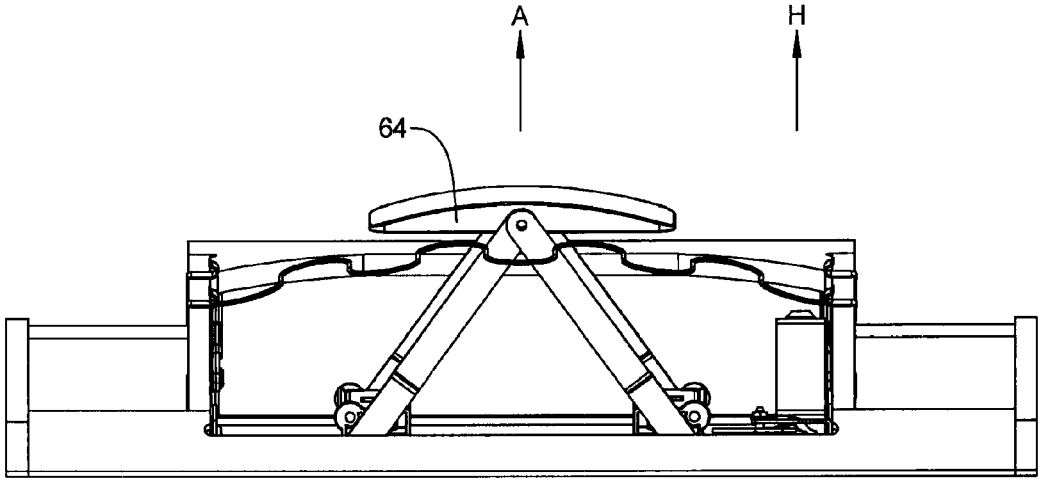
FIG. 14 is a top plan view of the seatback assembly similar to FIG. 13 further showing the lumbar mechanism in the fully forward extended position.

Referring to FIG. 14, lumbar pad 64 is shown after extension in the lumbar extension direction "A" to the fully extended position. The fully extended position of lumbar pad 64 positions lumbar pad 64 forward of biasing member 58 and provides maximum lumbar support for the occupant of the furniture member.

Figure 15:
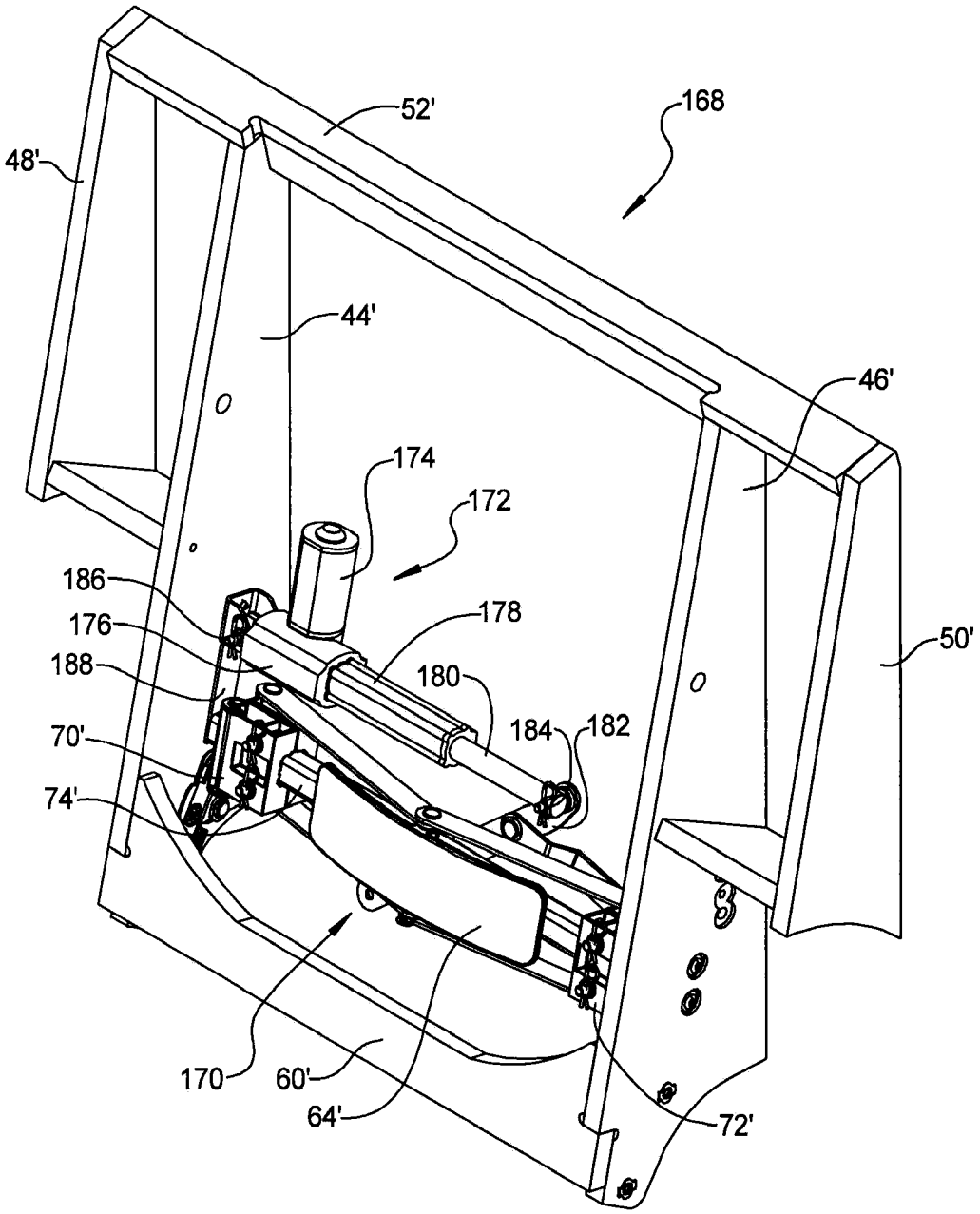
FIG. 15 is a front left perspective view of another embodiment of an in-line linkage mechanism installed in a furniture member seatback.

Referring to FIG. 15 and again to FIG. 3, a seatback 168 is modified from seatback 16 to include a lumbar mechanism 170 defining an embodiment modified from lumbar mechanism 62. Lumbar mechanism 170 includes an actuation mechanism 172 having an electrical actuator 174 coupled to a gear housing 176. A push rod housing 178 extends from gear housing 176 and provides for a retraction and extension of a push rod 180. Push rod 180 is shown in a fully extended position defining a fully retracted position of lumbar pad 64'. Push rod 180 is, in turn, rotatably connected to a drive link 182 using a drive link pin 184. An opposite end of actuation mechanism 172 is rotatably connected to first seatback side member 44' using a mechanism mounting pin 186 rotatably connected to a mounting bracket 188. Mounting bracket 188 is, in turn, fastenably connected to first seatback side member 44'.

Lumbar mechanism 170 incorporates many of the elements of lumbar mechanism 62, including first and second carriers 70', 72' and carrier support rod 74'. Differences between lumbar mechanism 170 and lumbar mechanism 62 primarily include the design and orientation of actuation mechanism 172 and the incorporation of drive link 182. The use of drive link 182 permits the reduction in a total number of links for lumbar mechanism 170 compared to the total number of links required for lumbar mechanism 62.

Figure 16:
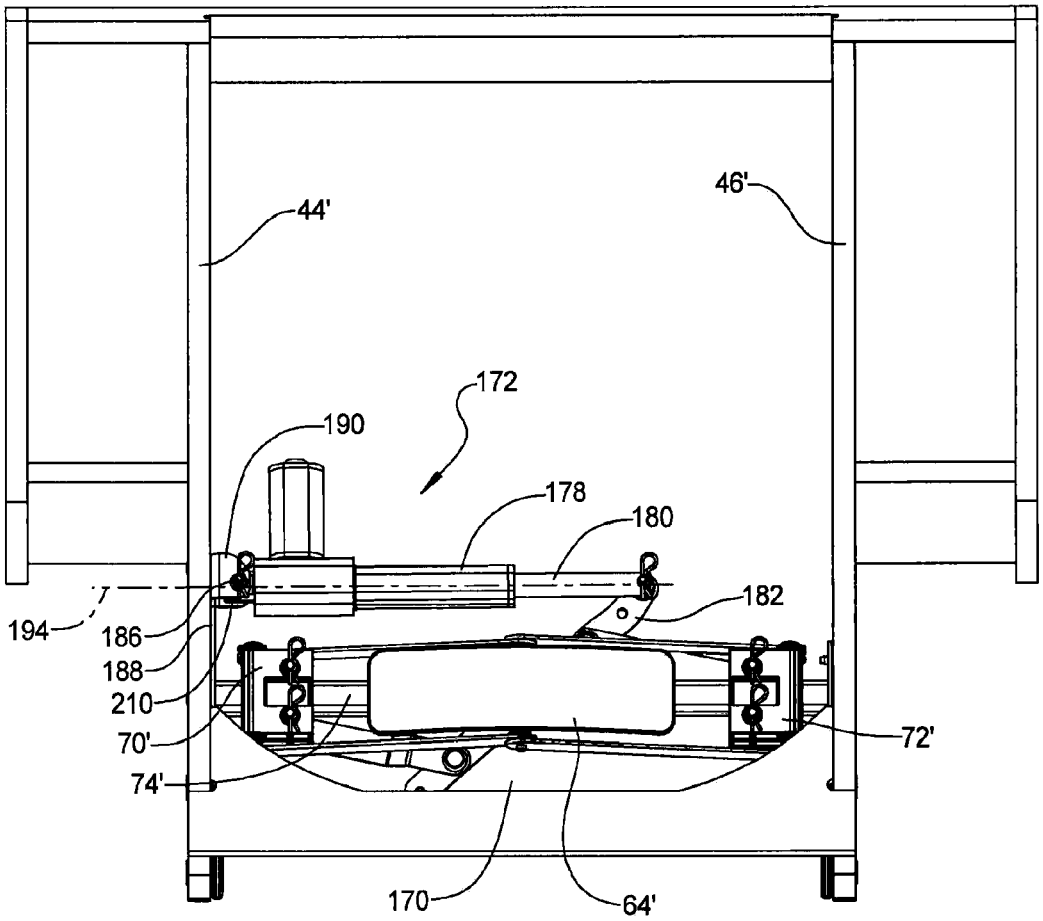
FIG. 16 is a front elevational view of the in-line linkage mechanism of FIG. 15.

Referring to FIG. 16, in the lumbar pad 64' fully retracted position, actuation mechanism 172 is oriented, as shown, having mechanism mounting pin 186 slidably and rotatably received through each of first and second bracket flanges 190, 192 which are formed as integral extensions of mounting bracket 188. In the fully retracted position of lumbar pad 64', the push rod housing 178 and push rod 180 are oriented substantially horizontal on a push rod longitudinal axis 194. Also in the fully retracted position of lumbar pad 64', each of the first and second carriers 70', 72' are positioned in their furthest outboard positions with respect to first and second seatback side members 44', 46'.

Figure 17:
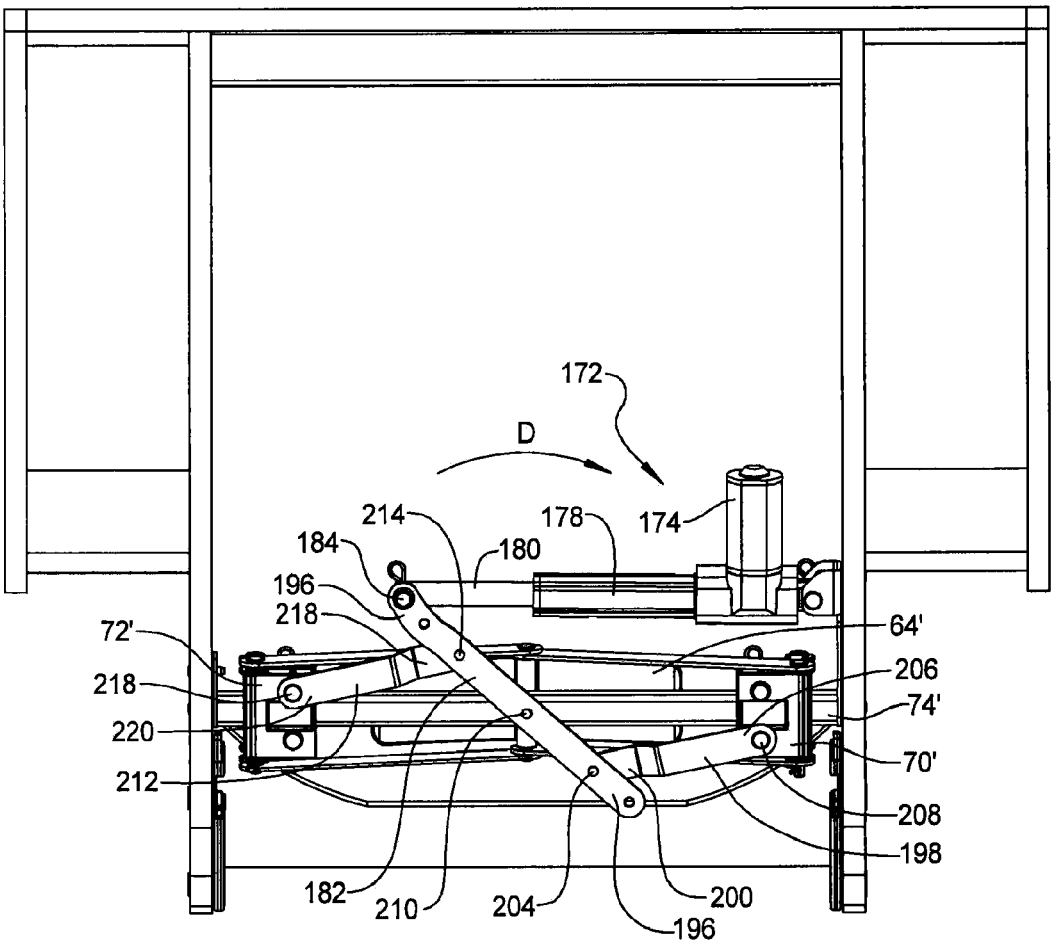
FIG. 17 is a rear elevational view of the in-line linkage mechanism of FIG. 15.

Referring to FIG. 17, drive link pin 184 is rotatably connected through a drive link first end 196 of drive link 182 to rotatably connect drive link 182 to push rod 180. A first carrier displacement link 198 is rotatably connected at a displacement link first end 200 to a drive link second end 202 of drive link 182 using a rotational fastener 204. A displacement link second end 206 of first carrier displacement link 198 is rotatably connected to first carrier 70' using a rotational fastener 208. A pin assembly 210 is substantially centrally positioned in drive link 182 between drive link first and second ends 196, 202 to rotatably connect drive link 182 to carrier support rod 74'. Drive link 182 is therefore rotatable from the fully retracted position of lumbar pad 64' shown by rotation in the axial rotation direction "D" with respect to a longitudinal axis of pin assembly 210. When returning from the lumbar pad extended position to the lumbar pad fully retracted position shown, drive link 182 will rotate in an opposite rotational direction with respect to axial rotation direction "D".

A second carrier displacement link 212 is connected using a rotational fastener 214 at a displacement link first end 216 of second carrier displacement link 212 to drive link 182. A rotational fastener 218 rotatably connects a displacement link second end 220 of second carrier displacement link 212 to second carrier 72'. Rotation of drive link 182 by displacement of push rod 180, which causes rotation of drive link 182 in the axial rotation direction "D", will thereafter cause first and second carriers 70', 72' to displace from their outward positions shown toward each other, as will be described in greater detail in reference to FIG. 20. As additionally evident, electrical actuator 174 is oriented substantially vertical and away from first carrier 70 to provide clearance for rotation of actuation mechanism 172 as well as displacement of first carrier 70'.

Figure 18:
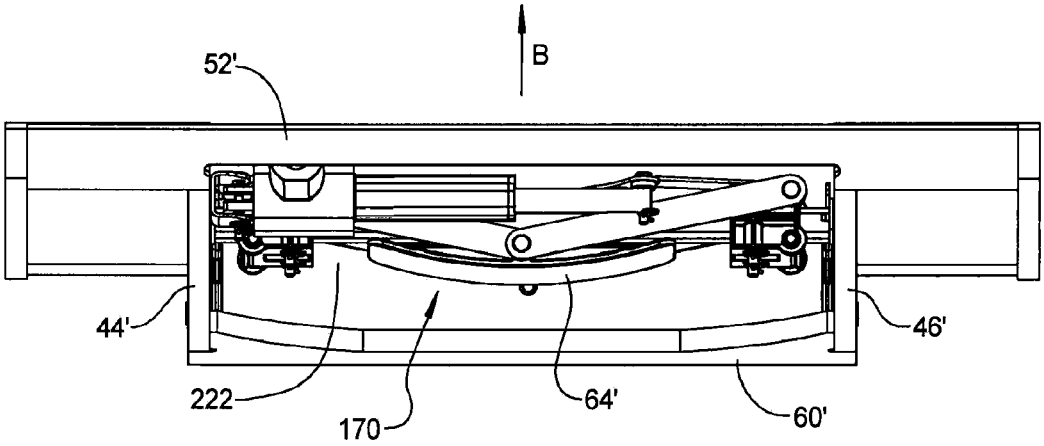
FIG. 18 is a top plan view of the in-line linkage mechanism of FIG. 15 in a fully retracted position.

Referring to FIG. 18, the fully retracted position for lumbar pad 64' is reached by retracting lumbar pad 64' in the lumbar retraction direction "B" until all of the components of lumbar mechanism 170 are received within a space envelope 222 defined between first and second seatback side members 44', 46' as well as between seatback upper frame member 52' and lower brace member 60'. This ensures that the occupant of the seat member cannot directly access any of the components including any of the link members of lumbar mechanism 170.

Figure 19:
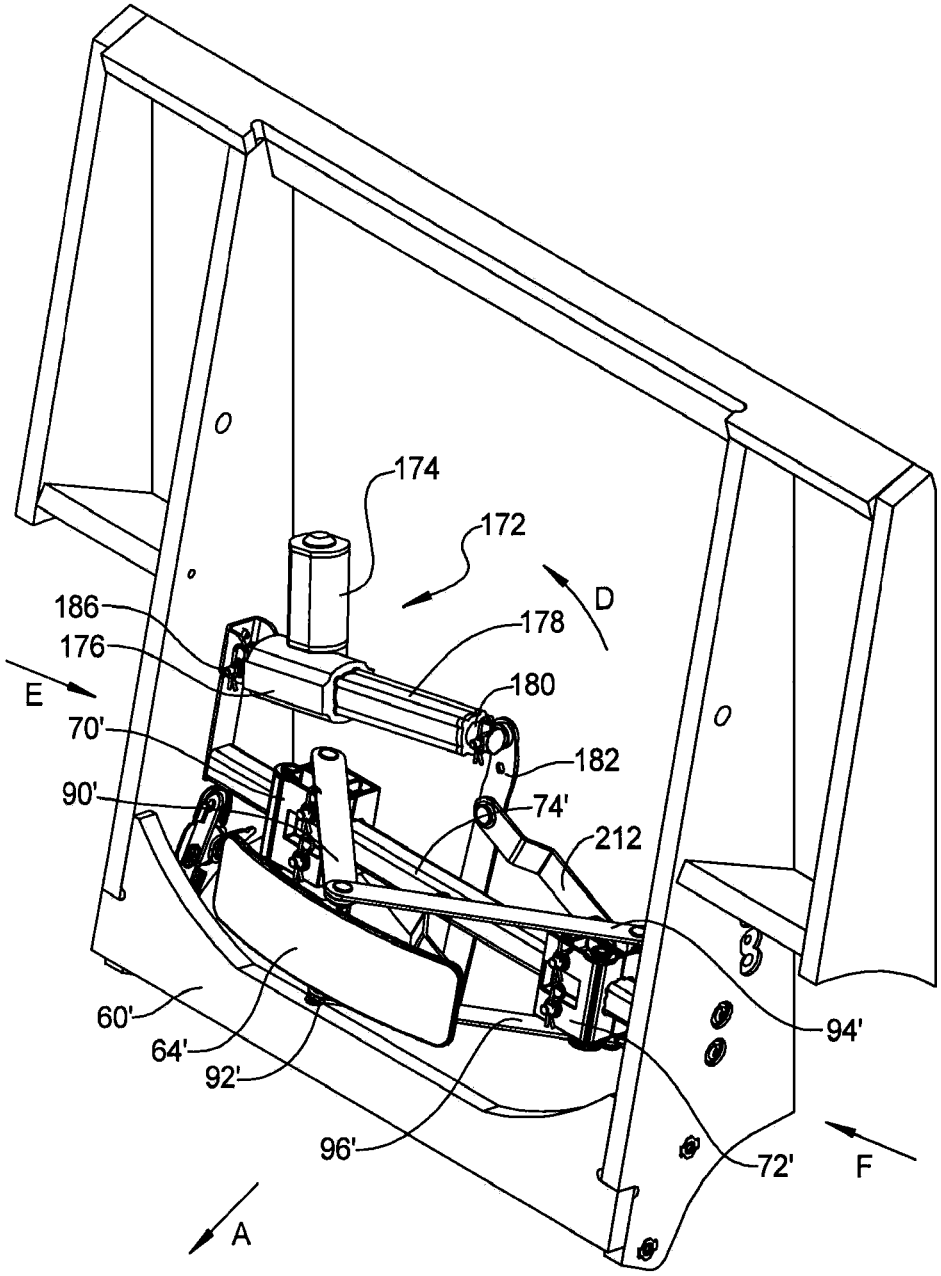
FIG. 19 is a front left perspective view of the in-line linkage mechanism of FIG. 15 in a fully extended position.

Referring to FIG. 19, lumbar pad 64' has been repositioned to a fully extended position by actuation of actuation mechanism 172. To accomplish this, an electrical signal is received by electrical actuator 174 which retracts push rod 180 using the components within gear housing 176 to the fully retracted position of push rod 180 shown. Retraction of push rod 180 causes rotation of drive link 182 in the axial rotation direction "D". This rotation of drive link 182 via displacement of both first and second carrier displacement links 198, 212 causes displacement of first carrier 70' in the first carrier displacement direction "E" and simultaneously causes displacement of second carrier 72' in the second carrier displacement direction "F". This co-displacement of first and second carriers 70', 72' displaces lumbar pad 64' by actuation of the first and second upper pad links 90', 94' and first and second lower pad links 92', 96'. First and second carriers 70', 72' are slidably disposed on carrier support rod 74' and total displacement of lumbar pad 64' in the lumbar extension direction "A" is limited by a total displacement of push rod 180 reaching a fully retracted position within push rod housing 178.

As push rod 180 retracts into push rod housing 178, the entire actuation mechanism 172 rotates with respect to mechanism mounting pin 186 to permit the rotation of drive link 182. In the fully extended position of lumbar pad 64', lumbar pad 64' extends forwardly of lower brace member 60'.

Figure 20:
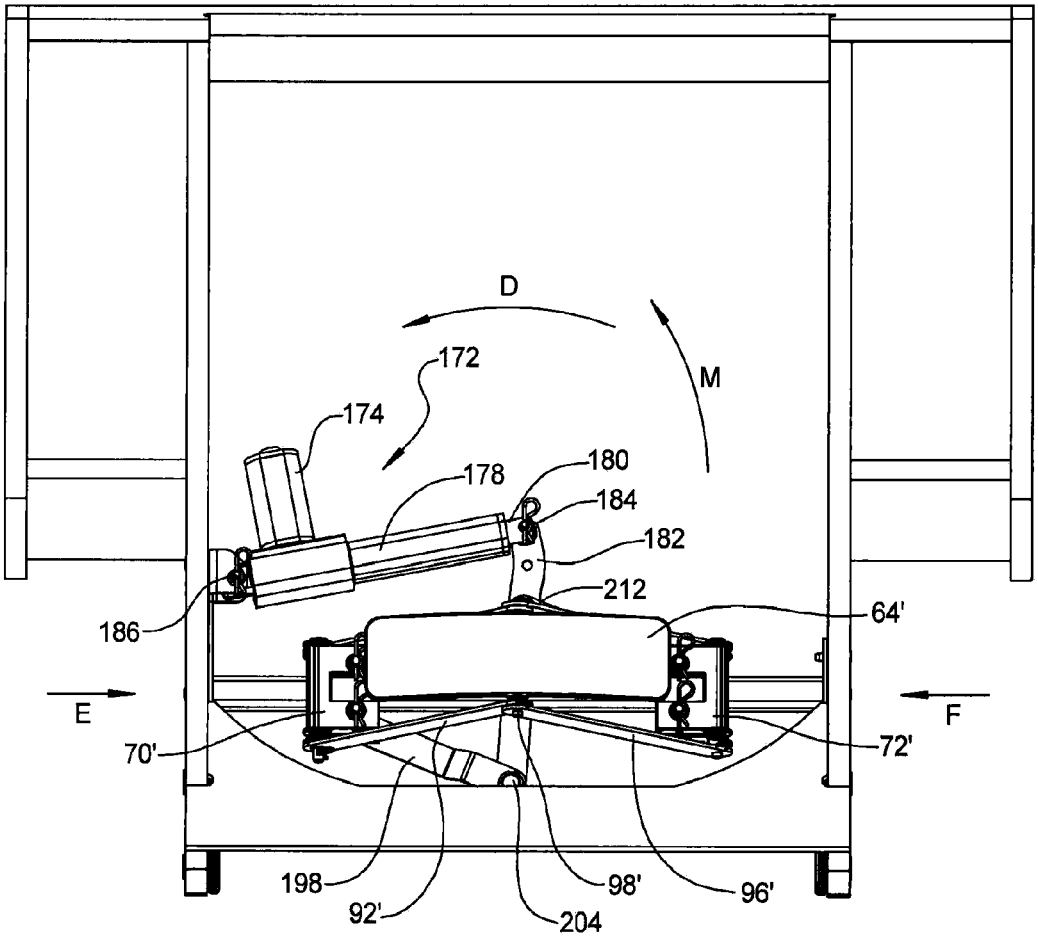
FIG. 20 is a front elevational view of the fully extended in-line linkage mechanism of FIG. 19.

Referring to FIG. 20, the rotational motion of actuation mechanism 172, with respect to mechanism mounting pin 186, is about an actuation mechanism arc of rotation "M" defined by the longitudinal axis of mechanism mounting pin 186. The drive link 182 rotates to a substantially vertical position as push rod 180 reaches its fully retracted position within push rod housing 178. Similar to the previous embodiments described herein, lumbar pad 64' is rotatably connectable using pad connecting pin 98' to the pad links such as first and second lower pad links 92, 96 shown.

Figure 21:
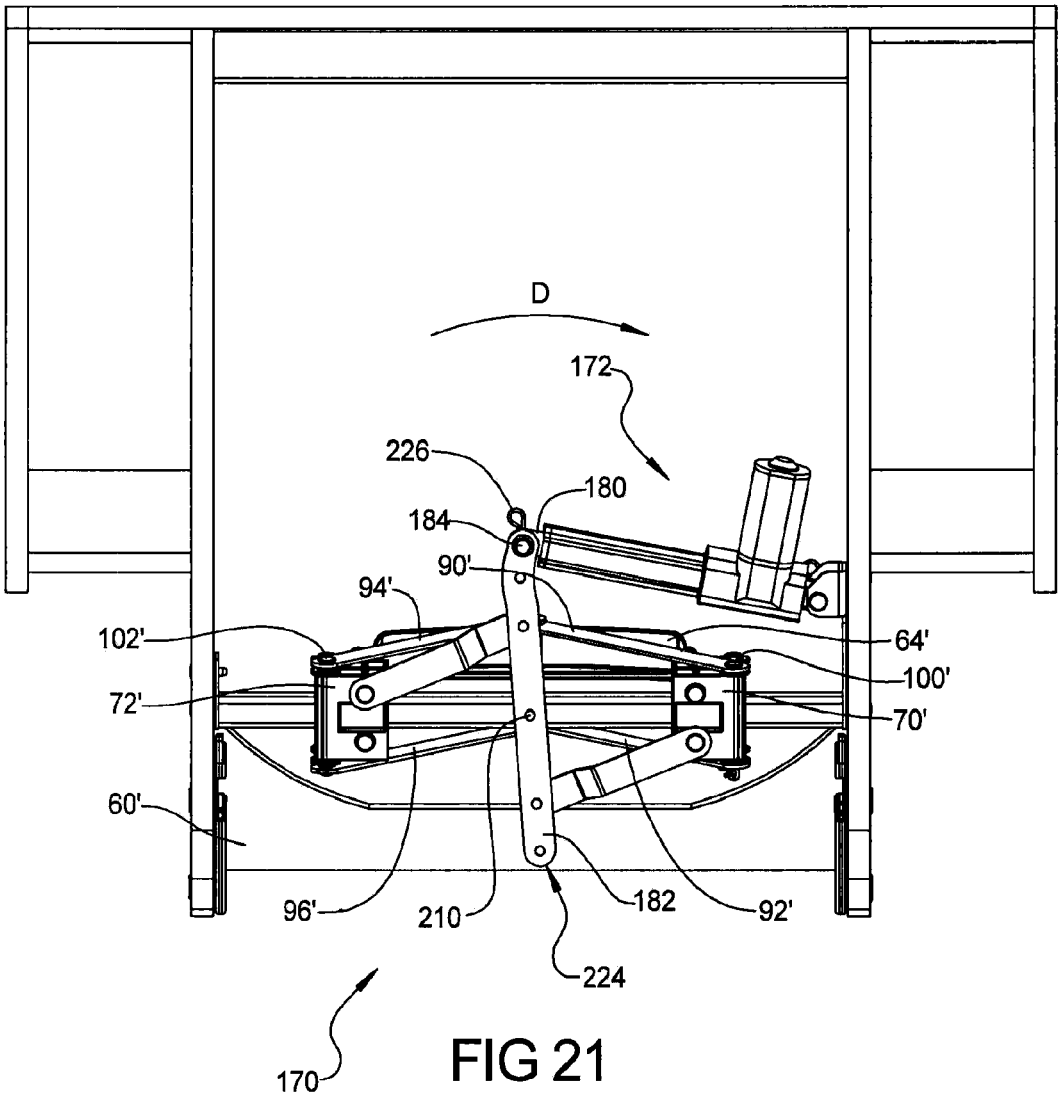
FIG. 21 is a rear elevational view of the fully extended in-line linkage mechanism of FIG. 19.

Referring to FIG. 21, further components of lumbar mechanism 170 which are similar to lumbar mechanism 62 include first and second carrier connecting pins 100', 102' which rotatably connect to the first and second carriers 70', 72', respectively. A retaining member 226, such as a cotter pin, can be used to releasably retain drive link pin 184 in the installed position with respect to push rod 180. In the fully extended position of lumbar pad 64', a free end 224 of drive link 182 is maintained within the space envelope defined by lower brace member 60'.

Figure 22:
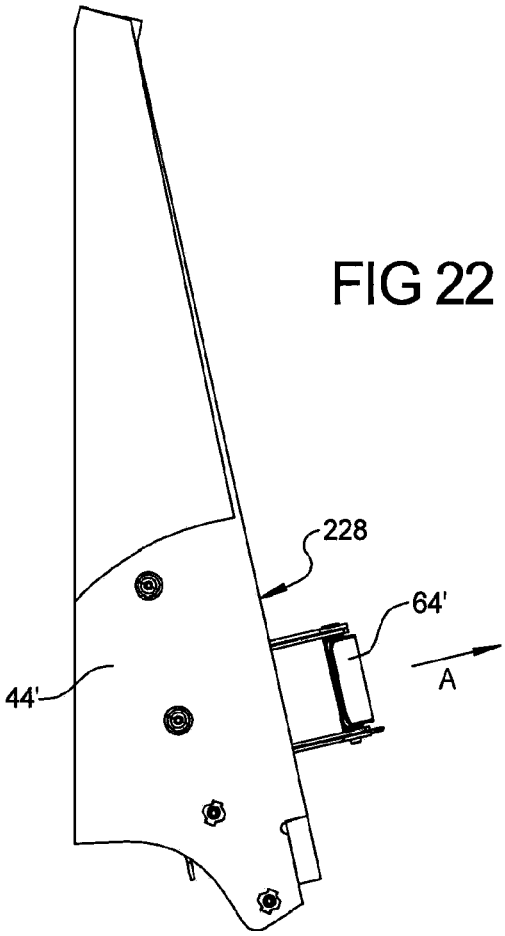
FIG. 22 is a right side elevational view of the fully extended in-line linkage mechanism of FIG. 19.

Referring to FIG. 22, as lumbar pad 64' reaches the fully extended position by travel in the lumbar extension direction "A", if lumbar pad 64' reaches a maximum displacement with respect to a forward face 228 of first seatback side member 44' and second seatback side member 46' (not clearly visible in this view) because of the forward extension of lumbar pad 64', the occupant of the furniture member is provided with a positive displacing lumbar pad which is not limited to the space envelope defined by the first and second seatback side members 44', 46'.

Figure 23:
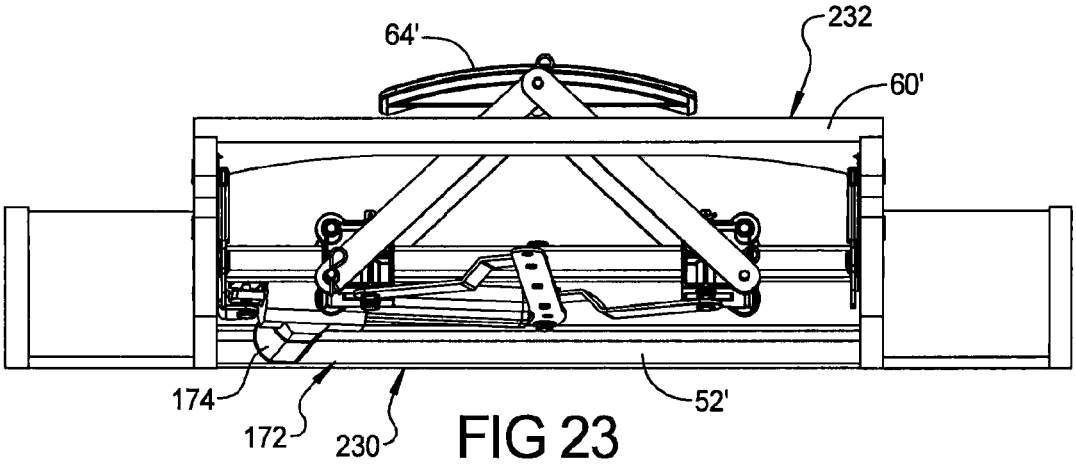
FIG. 23 is a bottom plan view of the fully extended in-line linkage mechanism of FIG. 19.

Referring to FIG. 23, in the fully extended position of lumbar pad 64', all of the components of actuation mechanism 172 are retained within a space envelope defined by a rear face 230 of seatback upper frame member 52', including the position of electrical actuator 174 which has reached its fully rotated position. Also in the fully extended condition, the lumbar pad 64' is positioned forward of a forward face 232 of lower brace member 60'.

Figure 24:
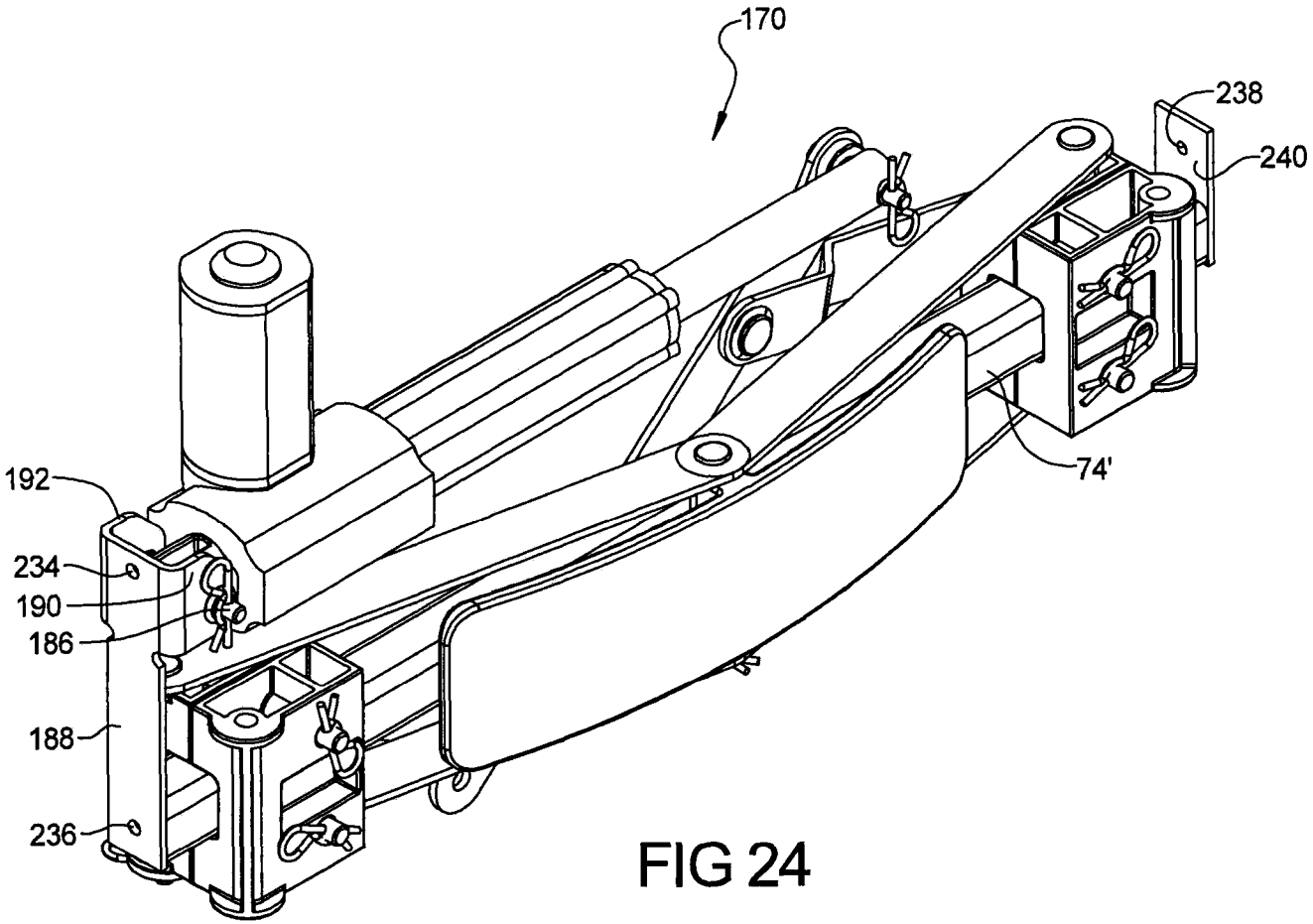
FIG. 24 is a front right perspective view of the in-line linkage mechanism of FIG. 15 shown removed from the furniture member seatback.

Referring to FIG. 24, lumbar mechanism 170 can be subassembled, as shown, prior to installation in the furniture member. Lumbar mechanism 170 can further include first and second apertures 234, 236 created in mounting bracket 188 which provide for fastener mounting of lumbar mechanism 170 to the furniture member frame. Similarly, at least one (and according to several embodiments—a plurality) of third apertures 238 are provided in a mounting bracket 240 fixedly connected at an opposite end of carrier support rod 74' with respect to mounting bracket 188. Third apertures 238 provide a similar function as first and second apertures 234, 236. As more clearly evident in FIG. 25, the first and second bracket flanges 190, 192 can be formed by bending material of mounting bracket 188 and creating thru apertures through first and second bracket flanges 190, 192 to rotatably and slidably receive mechanism mounting pin 186. According to several embodiments, both mounting bracket 188 and mounting bracket 240 are fixedly connected to opposite ends of carrier support rod 74' (e.g., by welding).

Referring to FIG. 25 and again to FIGS. 15-24, a seatback 242 is modified from seatback 168 to include a lumbar mechanism 244 defining an embodiment modified from lumbar mechanism 170. Lumbar mechanism 244 incorporates many of the elements of lumbar mechanism 170, including first and second carriers 70", 72" and carrier support rod 74". Differences between lumbar mechanism 244 and lumbar mechanism 170 primarily include incorporation of a force distribution plate 246 and associated elements. Force distribution plate 246 is connected to carrier support rod 74" using a pin assembly 248, which is longer than pin assembly 210, to include the additional thickness of force distribution plate 246. Force distribution plate 246 includes a first arc-shaped slot 250 which slidably guides a first guide pin 252 which is fixed to and extends from a drive link 254. Force distribution plate 246 further includes a second arc-shaped slot 256 which slidably guides a second guide pin 258 which is fixed to and extends from drive link 254. First and second guide pins 252, 258 are equally spaced with respect to pin assembly 248. First carrier displacement link 198' is rotatably connected to drive link 254 using rotational fastener 204', similar to the connection to drive link 182, and displaces first carrier 70" during rotation of drive link 254. Second carrier displacement link 212' is rotatably connected to drive link 254 using rotational fastener 214', also similar to the connection to drive link 182, and displaces second carrier 72" during rotation of drive link 254.

Forces acting through rotational fasteners 204', 214' during rotation of drive link 254 are distributed through first and second guide pins 252, 258 and therefore through force distribution plate 246, thereby reducing the force creating a moment through pin assembly 248. A surface area of force distribution plate 246 in contact with drive link 254 further distributes frictional force of the rotating drive link 254 to the force distribution plate 246 in lieu of to carrier support rod 74".

Figure 25:
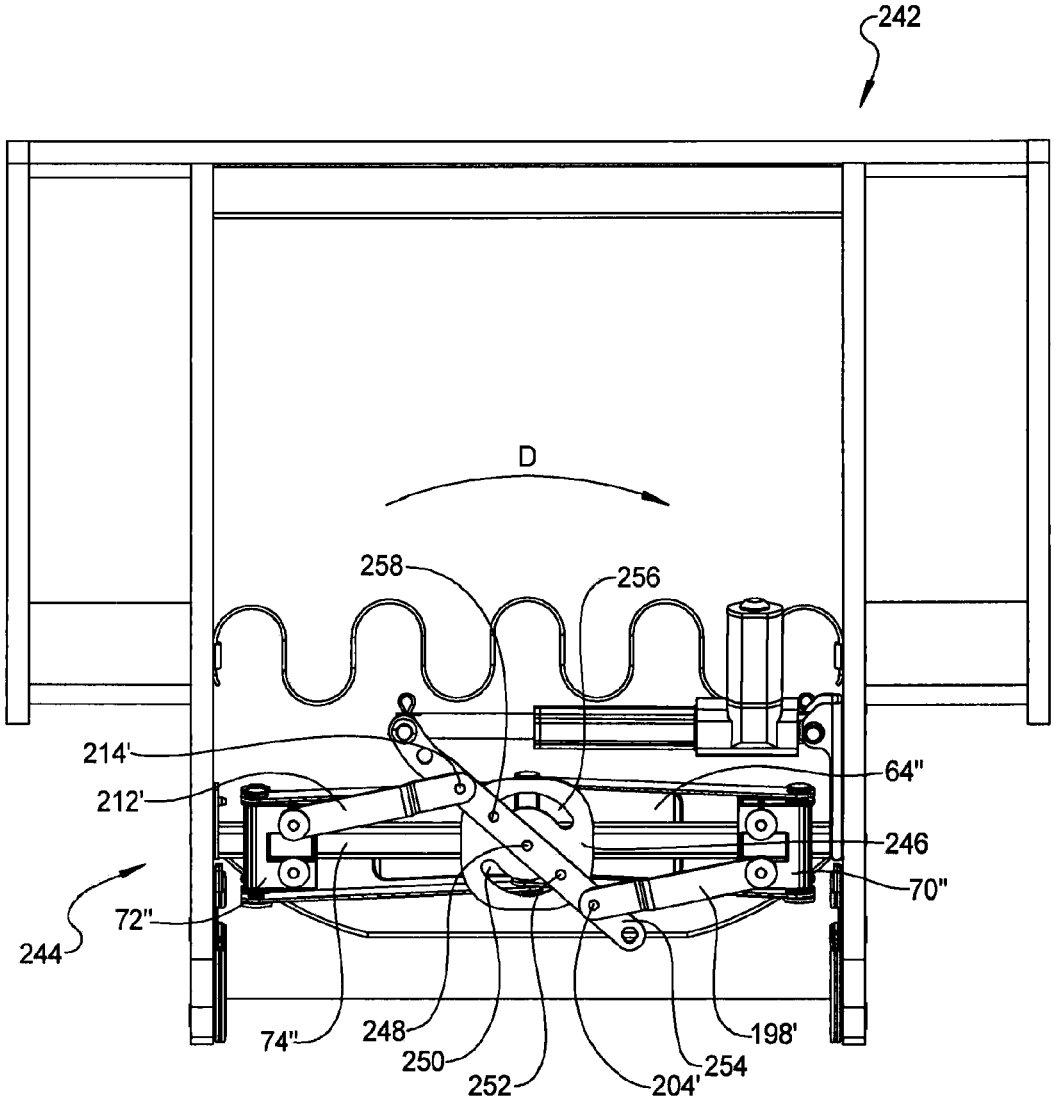
FIG. 25 is a rear elevational view of an in-line linkage mechanism modified from the mechanism of FIG. 15.
Figure 26:
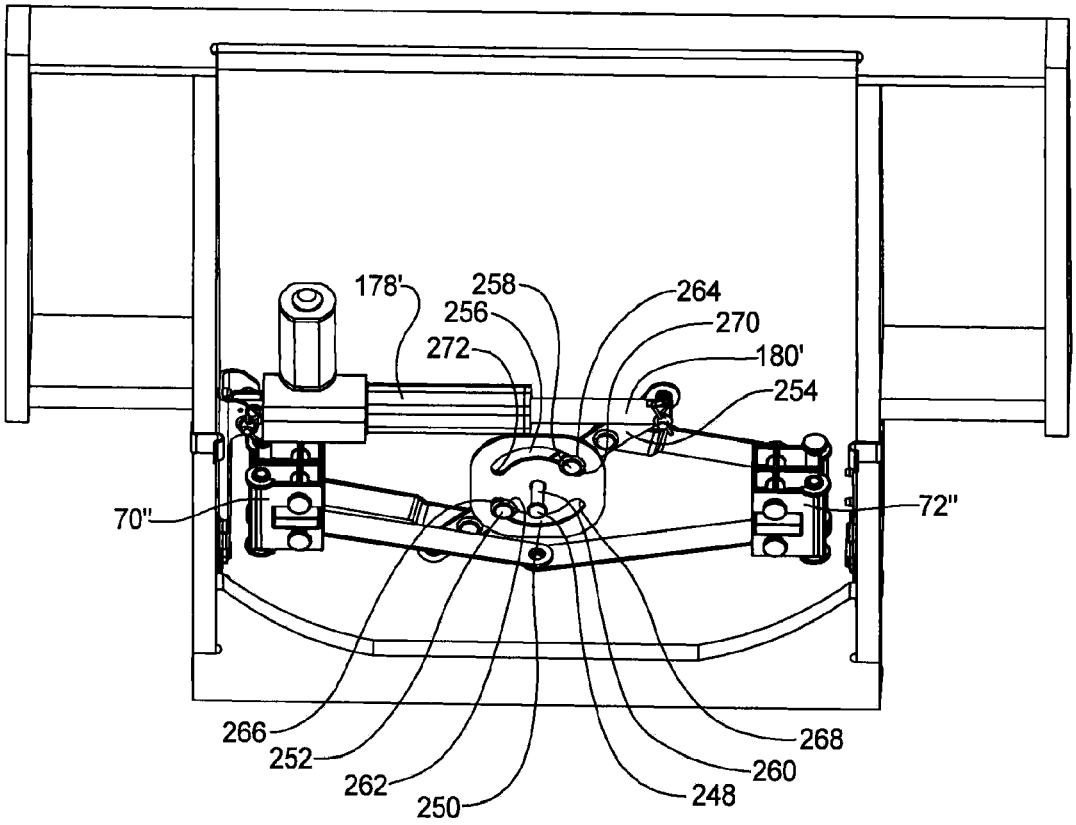
FIG. 26 is a front elevational view of the linkage mechanism of FIG. 25.

Referring to FIG. 26 and again to FIGS. 17 and 25, drive link 254, first and second carrier links 198', 212', and carrier support rod 74" have been removed for clarity. Pin assembly 248 can include a larger diameter pin shaft 260 compared to pin assembly 210 to reduce moment loading of the pin assembly 248. A polymeric bushing 262 disposed around first guide pin 252 further distributes the forces acting through first guide pin 252, as well as reduces frictional resistance to sliding motion of first guide pin 252 between force distribution plate 246 and drive link 254. A polymeric bushing 264 is disposed around second guide pin 258 for the same purposes.

During operation, as push rod 180' is retracted into push rod housing 178', drive link 254 is induced to rotate with respect to pin assembly 248 about axial rotation arc "D". From the fully outward extended positions of first and second carriers 70", 72" which provide the fully retracted position of lumbar pad 64", rotation of drive link 254 causes displacement of first guide pin 252 from a first slot end 266 to a second slot end 268 of first arc-shaped slot 250. At the same time, rotation of drive link 254 causes displacement of second guide pin 258 from a first slot end 270 to a second slot end 272 of second arc-shaped slot 256. Rotation of drive link 254 also pulls first and second carriers 70", 72" toward each other, causing outward extension of lumbar pad 64".

Figure 27:
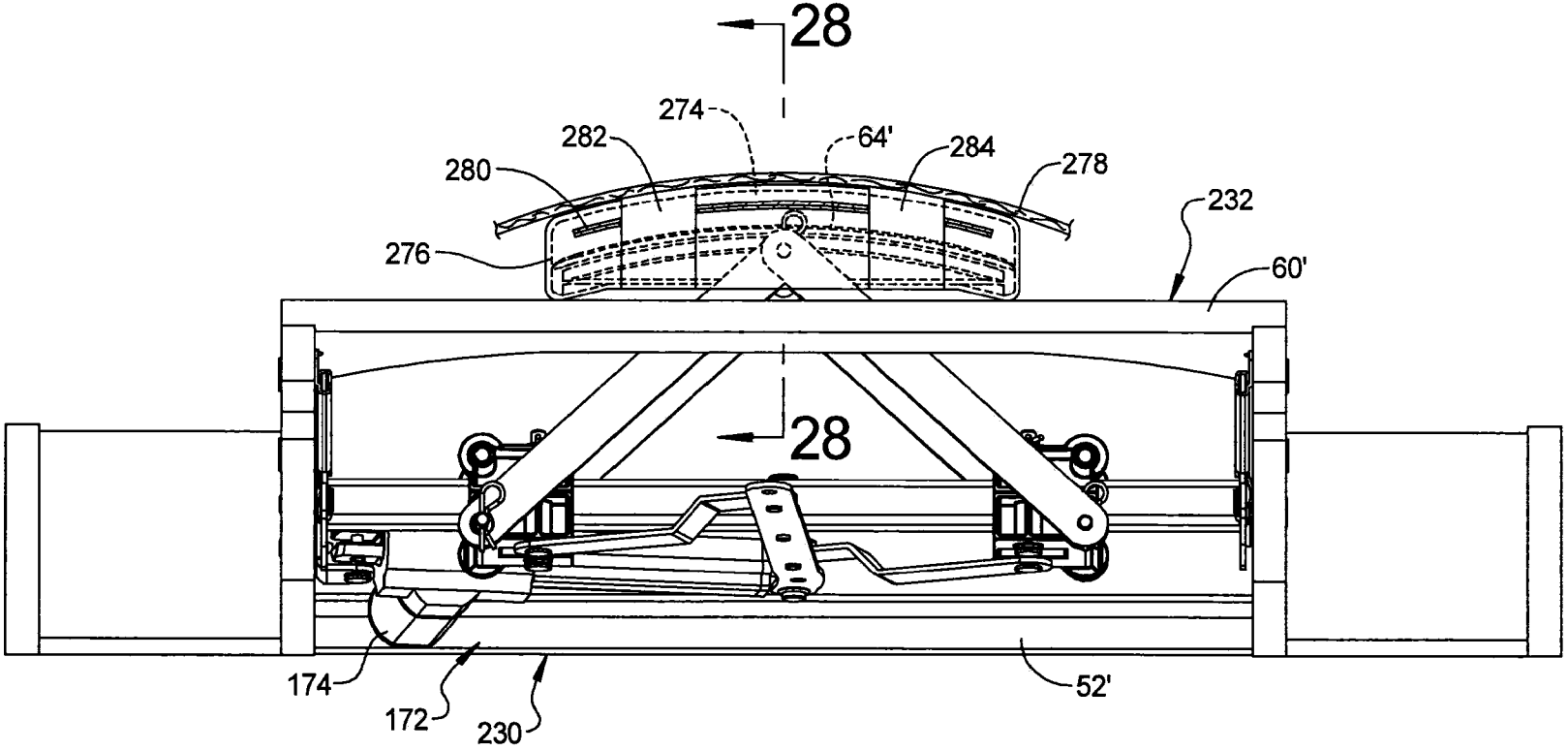
FIG. 27 is a bottom plan view of an in-line linkage mechanism having an upholstery connected, padded insert covering the lumbar pad.

Referring to FIG. 27, an elastically compressible and flexible material pad 274 is positioned in a flexible material pocket 276 which is connected to an inner, rearward facing side of a lumbar upholstery portion 278. Material pad 274 can be made of a polymeric foam material to maintain its initial volume and shape following compression. Material pad 274 is positioned in contact with a forward, outward facing side of lumbar pad 64' to provide additional occupant comfort at the lumbar support area. Both material pad 274 and lumbar pad 64' are positioned in pocket 276. An interior of pocket 276 is accessible via an enclosure member 280, such as a zipper. Pocket 276 receives and retains lumbar pad 64' and material pad 276 so that following extension and during subsequent retraction of lumbar pad 64' the material of lumbar upholstery portion 278, material pad 274, and pocket 276 are retracted together with lumbar pad 64' to its retracted position. Retention of pocket 276 and material pad 274 with respect to lumbar pad 64' is achieved by first and second straps 282, 284 attached to pocket 276 and wrapped about a rear facing partial perimeter of lumbar pad 64'. First and second straps 282, 284 can be attached by sewing, by hook and loop connectors, or the like methods.

Figure 28:
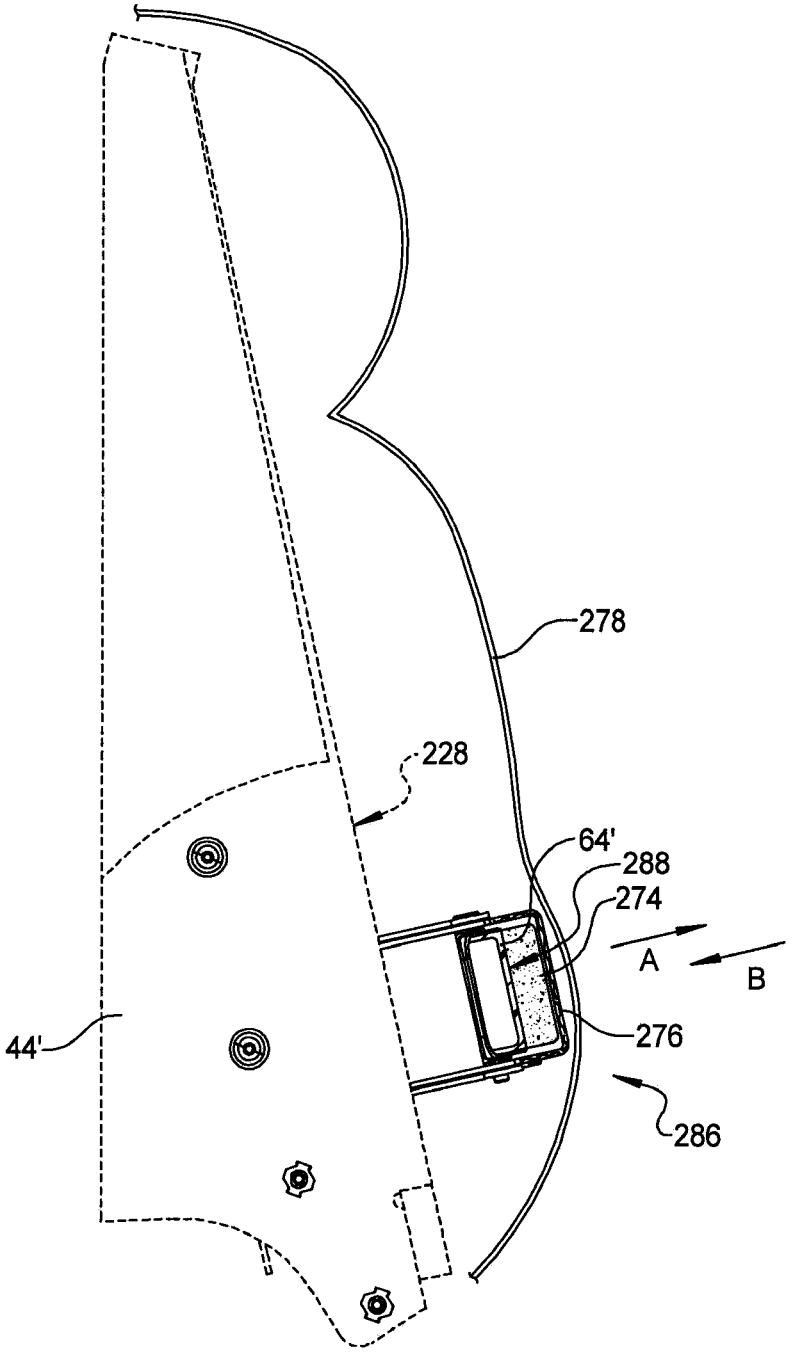
FIG. 28 is a cross sectional side elevational view taken at section 28 of FIG. 27.

Referring to FIG. 28, material pad 274 is maintained in direct contact with lumbar pad 64' and retained within pocket 276 during extension of lumbar pad 64' in the extension direction "A" and during retraction in the retraction direction "B". An occupant lumbar support area 286 of lumbar upholstery portion 278 therefore moves with lumbar pad 64' to prevent lumbar upholstery portion 278 from remaining partially extended following retraction of lumbar pad 64'. A geometry of material pad 274 directly mimics a forward facing side 288 of lumbar pad 64'. According to several embodiments, material pad 274 is fixed, for example, by an adhesive bonding material to forwarding facing side 288.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A power lift lumbar support system for a furniture member, comprising:

a lumbar pad;

a scissoring portion rotatably connected to the lumbar pad and moving the lumbar pad between a fully retracted and a fully extended position when rotated;

a powered actuator acting to displace the lumbar pad by displacement of the scissoring portion;

a lumbar actuation portion connected to the scissoring portion, the lumbar actuation portion including a displaceable shaft, movement of the displaceable shaft in a first displacement direction displacing the lumbar pad toward the fully extended position and movement of the displaceable shaft in an opposite second displacement direction moving the lumbar pad toward the fully retracted position; and an actuation link connecting a free end of the displaceable shaft to the powered actuator.

2. The power lift lumbar support system of claim 1, further including a bracket supporting the lumbar actuation portion.

3. The power lift lumbar support system of claim 2, further including a U-shaped force transfer link rotatably connected by a pin at a first end to the bracket and rotatably connected at a second end to a drive link.

4. The power lift lumbar support system of claim 3, wherein the actuation link is rotatably connected to the force transfer link between the first and second ends such that movement of the displaceable shaft causes the force transfer link to rotate with respect to the pin pulling the drive link toward the actuation link causing extension of the scissoring portion.

5. The power lift lumbar support system of claim 3, wherein the drive link is rotatably connected to a connecting link which is rotatably connected to each of a first and a second carrier displacement link.

6. The power lift lumbar support system of claim 5, further including a carrier support rod having first and second carriers slidably disposed on the carrier support rod, the first carrier displacement link connected to the first carrier and the second carrier displacement link connected to the second carrier.

7. The power lift lumbar support system of claim 6, further including at least first and second pad links individually connecting one of the first or second carriers to the lumbar pad.

8. The power lift lumbar support system of claim 1, wherein the lumbar actuation portion further includes a power transfer device having the displaceable shaft axially disposed within the power transfer device.

9. A power lift lumbar support system for a furniture member, comprising:

a lumbar pad;

a scissoring portion rotatably connected to the lumbar pad to move the lumbar pad between a fully retracted and a fully extended position;

a lumbar actuation portion connected to the scissoring portion and driving the scissoring portion using a powered actuator to displace the lumbar pad when the powered actuator is actuated;

a carrier support rod having first and second carriers slidably disposed on the carrier support rod;

a linkage set connecting the lumbar actuation portion to the scissoring portion, the linkage set including:

a first and a second carrier displacement link each connected to one of the first or second carriers;

a link connected to the lumbar actuation portion, the link operating to displace the first and the second carrier displacement links; and a connecting link rotatably connected to both the first and second carrier displacement links.

10. The power lift lumbar support system of claim 9, wherein the connecting link is further rotatably connected to the carrier support rod.

11. The power lift lumbar support system of claim 10, wherein the scissoring portion is connected to each of the first and second carriers, displacement of the first and second carriers toward each other by the first and second carrier displacement links operating through the scissoring portion to displace the lumbar pad away from the carrier support rod and toward the fully extended position.

12. The power lift lumbar support system of claim 10, wherein the linkage set further includes a drive link rotatably connected to each of the link and the connecting link.

13. The power lift lumbar support system of claim 12, wherein the connecting link is further rotatably connected to the carrier support rod by a pin.

14. The power lift lumbar support system of claim 13, wherein the pin is positioned at a substantially central position of the carrier support rod.

15. The power lift lumbar support system of claim 9, wherein movement of the first and second carriers is caused by operation of the lumbar actuation portion by displacement of an actuation link connected to the linkage set, the actuation link connected to the powered actuator such that operation of the powered actuator displaces the actuation link and the linkage set thereby slidably displacing the first and second carriers.

16. A power lift lumbar support system of a furniture member, comprising:

a lumbar pad;

a scissoring portion rotatably connected to the lumbar pad and moving the lumbar pad between a fully retracted and a fully extended position when rotated;

a lumbar mechanism, including:

an electrical actuator coupled to a gear housing operating to extend or retract a push rod;

a drive link rotatably connected to the push rod using a drive link pin a mounting bracket connected to a first seatback side member of the furniture member and a mechanism mounting pin rotatably connecting the electrical actuator to the mounting bracket;

first and second carriers slidably supported on a carrier support rod, the carrier support rod connected to the mounting bracket and oppositely to a second seatback side member;

a drive link connected to the push rod and linked to each of the first and second carriers; and a pad link connecting each of the first and second carriers to the lumbar pad, such that displacement of the push rod slidably displaces the first and second carriers thereby extending or retracting the lumbar pad.

17. The power lift lumbar support system of claim 16, wherein in a fully retracted position of the lumbar pad the push rod is oriented substantially horizontally and each of the first and second carriers are positioned at a furthest outboard position with respect to the first and second seatback side members.

18. The power lift lumbar support system of claim 16, further including a drive link pin rotatably connected through a drive link first end of the drive link to rotatably connect the drive link to the push rod.

19. The power lift lumbar support system of claim 18, further including a first carrier displacement link rotatably connected at a displacement link first end to a drive link second end of the drive link.

20. The power lift lumbar support system of claim 19, further including a displacement link second end of the first carrier displacement link rotatably connected to the first carrier.

21. The power lift lumbar support system of claim 16, further including a pin assembly substantially centrally positioned in the drive link between drive link first and second ends to rotatably connect the drive link to the carrier support rod.

22. A power lift lumbar support system for a furniture member, comprising:

a lumbar pad;

a scissoring portion rotatably connected to the lumbar pad to move the lumbar pad between a fully retracted and a fully extended position;

a lumbar actuation mechanism connected to the scissoring portion and driving the scissoring portion to displace the lumbar pad when the lumbar actuation mechanism is actuated;

a carrier support rod having first and second carriers slidably disposed on the carrier support rod;

an electrical actuator having a push rod extendable and retractable by operation of the electrical actuator; and a linkage set connecting the lumbar actuation mechanism to the scissoring portion, the linkage set including a drive link rotatably connected to the push rod.

23. The power lift lumbar support system of claim 22, wherein the linkage set further includes a first and a second carrier displacement link each directly rotatably connected to the drive link and operating when the push rod is extended or retracted to displace the scissoring portion.

24. The power lift lumbar support system of claim 23, wherein the first carrier displacement link is rotatably connected to the first carrier and the second carrier displacement link is rotatably connected to the second carrier, the first and second carriers individually rotatably connected to upper and lower pad links of the scissoring portion.

25. The power lift lumbar support system of claim 22, wherein the lumbar actuation mechanism includes a push rod housing connected to the electrical actuator, the push rod is extendable and retractable with respect to the push rod housing.

26. The power lift lumbar support system of claim 22, further including a pin for rotatably connecting the lumbar actuation mechanism to a furniture member such that the lumbar actuation mechanism is rotatable with respect to the pin.

27. A power lift lumbar support system for a furniture member, comprising:

a lumbar pad;

a scissoring portion rotatably connected to the lumbar pad to move the lumbar pad between a fully retracted and a fully extended position;

a carrier support rod;

first and second carriers slidably disposed on the carrier support rod, the scissoring portion connected to each of the first and second carriers;

a linkage set connected to the first and second carriers, the linkage set including a connecting link rotatably connected to the carrier support rod between the first and second carriers; and a lumbar actuation portion having a powered actuator connected to the linkage set driving the first and second carriers to displace the scissoring portion and thereby the lumbar pad when actuated.

28. The power lift lumbar support system of claim 27, wherein the scissoring portion includes first and second pad links, the first pad link rotatably connected to the first carrier and the second pad link rotatably connected to the second carrier.

29. The power lift lumbar support system of claim 27, wherein both the first and second link pads are rotatably connected to a pad connecting pin rotatably connected to the lumbar pad.

30. The power lift lumbar support system of claim 27, wherein the linkage set includes first and second carrier displacement links, rotation of the connecting link causing displacement of the first and second carriers toward each other operating through the scissoring portion to displace the lumbar pad away from the carrier support rod and toward the fully extended position.

* * * * *